US011096002B2

(12) United States Patent
Pihlajakuja et al.

(10) Patent No.: US 11,096,002 B2
(45) Date of Patent: Aug. 17, 2021

(54) ENERGY-RATIO SIGNALLING AND SYNTHESIS

(71) Applicant: NOKIA TECHNOLOGIES OY, Espoo (FI)

(72) Inventors: Tapani Pihlajakuja, Vantaa (FI); Arto Juhani Lehtiniemi, Lempäälä (FI); Antti Johannes Eronen, Tampere (FI); Lasse Juhani Laaksonen, Tampere (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 16/502,838

(22) Filed: Jul. 3, 2019

(65) Prior Publication Data

US 2020/0015028 A1 Jan. 9, 2020

Related U.S. Application Data

(60) Provisional application No. 62/693,477, filed on Jul. 3, 2018.

(51) Int. Cl.

| | |
|---|---|
| ***H04S 7/00*** | (2006.01) |
| ***G10L 25/21*** | (2013.01) |
| ***H04S 3/00*** | (2006.01) |

(52) U.S. Cl.

CPC ..... *H04S 7/302* (2013.01); *G10L 25/21* (2013.01); *H04S 3/008* (2013.01); *H04S 2400/01* (2013.01); *H04S 2420/11* (2013.01)

(58) Field of Classification Search

CPC ... G10L 19/0017; G10L 19/008; G10L 19/02; G10L 19/0204; G10L 19/0212;

(Continued)

(56) References Cited

U.S. PATENT DOCUMENTS

| | | | | |
|---|---|---|---|---|
| 10,075,802 | B1 * | 9/2018 | Kim | G10L 19/008 |
| 2016/0088415 | A1 * | 3/2016 | Krueger | G10L 19/008 381/22 |
| 2018/0262856 | A1 * | 9/2018 | Wang | H04S 7/308 |

FOREIGN PATENT DOCUMENTS

| | | | |
|---|---|---|---|
| EP | 2360681 | A1 | 8/2011 |
| GB | 2549532 | A | 10/2017 |

(Continued)

OTHER PUBLICATIONS

Ahonen, J. et al., *Diffuseness Estimation Using Temporal Variation of Intensity Vectors*, 2009 IEEE Workshop on Applications of Signal Processing to Audio and Acoustics (Oct. 2009) 285-288.

(Continued)

*Primary Examiner* — Walter F Briney, III

(74) *Attorney, Agent, or Firm* — Alston & Bird LLP

(57) ABSTRACT

An apparatus comprising at least one processor and at least one memory including a computer program code, the at least one memory and the computer program code configured to, with the at least one processor, cause the apparatus at least to: receive at least one audio signal; obtain, associated with the at least one audio signal over at least one frequency band: at least one spatial audio energy ratio parameter; and at least one remainder energy ratio, wherein a sum of the at least one spatial audio energy ratio parameter and the at least one remainder energy ratio over the frequency band equal a determined value; and control a transmission/storage of the at least one spatial audio energy ratio, and the at least one remainder energy ratio.

22 Claims, 15 Drawing Sheets

(58) Field of Classification Search
CPC ..... G10L 19/18; G10L 19/20; G10L 19/22; G10L 19/24; G10L 25/21; H04S 3/008; H04S 2400/11; H04S 2420/03; H04S 2420/01
See application file for complete search history.

(56) References Cited

FOREIGN PATENT DOCUMENTS

| | | | | |
|---|---|---|---|---|
| GB | 2551780 | * | 1/2018 | ..... H04S 7/00 |
| GB | 2554446 A | | 4/2018 | |

OTHER PUBLICATIONS

Laitinen, M-V.et al., *Utilizing Instantaneous Direct-to-Reverberant Ratio in Parametric Spatial Audio Coding*, Audio Engineering Society, Convention Paper 8804 (Oct. 2012) 10 pages.
Laitinen, M-V, et al., *Reproducing Applause-Type Signals with Directional Audio Coding*, J. Audio Eng. Soc., vol. 59, No. 1/2, (Jan./Feb. 2011) 29-43.
Pihlajamaki, T. et al., *Synthesis of Spatially Extended Virtual Sources With Time-Frequency Decomposition of Mono Signals*, J. Audio Eng. Soc., vol. 62, No. 7/8, (Jul./Aug. 2014) 467-484.
International Search Report and Written Opinion for Application No. PCT/FI2019/050517 dated Dec. 17, 2019, 15 pages.
*On Spatial Metadata for IVAS Spatial Audio Input Format*, Tdoc S4 (18)0462, Nokia Corporation, 3GPP TSG-SA4#98 Meeting (Apr. 2018) 7 pages.

* cited by examiner

ENERGY-RATIO SIGNALLING AND SYNTHESIS

CROSS-REFERENCE TO RELATED APPLICATIONS

This application claims priority to U.S. Provisional Application No. 62/693,477, filed Jul. 3, 2018, the entire contents of which are incorporated herein by reference.

FIELD

The present application relates to apparatus and methods for energy ratio signalling and synthesis, but not exclusively for energy ratio signalling and synthesis within a spatial audio encoder and decoder.

BACKGROUND

Parametric spatial audio processing is a field of audio signal processing where the spatial aspect of the sound is described using a set of parameters. For example, in parametric spatial audio capture from microphone arrays, it is a typical and an effective choice to estimate from the microphone array signals a set of parameters such as directions of the sound in frequency bands, and the ratios between the directional and non-directional parts of the captured sound in frequency bands. These parameters are known to well describe the perceptual spatial properties of the captured sound at the position of the microphone array. These parameters can be utilized in synthesis of the spatial sound accordingly, for headphones binaurally, for loudspeakers, or to other formats, such as Ambisonics.

SUMMARY

There is provided according to a first aspect an apparatus comprising at least one processor and at least one memory including a computer program code, the at least one memory and the computer program code configured to, with the at least one processor, cause the apparatus at least to: receive at least one audio signal; obtain, associated with the at least one audio signal over at least one frequency band: at least one spatial audio energy ratio parameter; and at least one remainder energy ratio, wherein a sum of the at least one spatial audio energy ratio parameter and the at least one remainder energy ratio over the frequency band equal a determined value; and control a transmission/storage of the at least one spatial audio energy ratio, and the at least one remainder energy ratio.

The apparatus may be further caused to obtain associated with the at least one audio signal over at least one frequency band at least one spatial audio direction parameter, wherein the apparatus caused to obtain, associated with the at least one audio signal over at least one frequency band: at least one spatial audio energy ratio parameter; and at least one remainder energy ratio may be further caused to obtain: at least one first type energy ratio, wherein each of the at least one first type energy ratio may be associated with the at least one spatial audio direction parameter; and at least one second type energy ratio, wherein a sum of the at least one first type energy ratio, the at least one second type energy ratio and the at least one remainder energy ratio over the frequency band equal the determined value.

The at least one first type energy ratio may be at least one direct-to-total energy ratio and the at least one second type energy ratio may be at least one diffuse-to-total energy ratio.

The apparatus caused to control a transmission/storage of the at least one spatial audio energy ratio, and the at least one remainder energy ratio may be caused to select N−1 from a total N number of ratios to be transmitted/stored.

The apparatus caused to select N−1 from a total N number of ratios to be transmitted/stored may be caused to select N−1 from a total N number of ratios to be transmitted/stored based on an analysis of the at least one audio signal.

The apparatus caused to select N−1 from a total N number of ratios to be transmitted/stored based on an analysis of the at least one audio signal may be caused to perform at least one of: a long term classification; and a short term classification.

The apparatus caused to control a transmission/storage of the at least one spatial audio energy ratio, and the at least one remainder energy ratio may be caused to reduce a number of the at least one spatial audio energy ratio and at least one remainder energy ratio.

The apparatus caused to reduce a number of the at least one spatial audio energy ratio and at least one remainder energy ratio may be caused to: identify at least one ratio based on a value of the ratio from: the at least one spatial audio energy ratio and/or at least one remainder energy ratio; either combine a value of the identified ratio with at least one other ratio of a same type, or compensate at least one ratio of a different type based on the value of the identified ratio.

The apparatus caused to control a transmission/storage of the spatial audio energy ratio and the at least one remainder energy ratio may be caused to: discard at least one spatial audio direction parameter; distribute any first type energy ratio values associated with any discarded at least one spatial audio direction parameter among any first type energy ratios associated with any remaining spatial audio direction parameters and/or the second type energy ratios, wherein the distribution may be based on an angular difference between a remaining direction spatial audio direction parameters and the discarded spatial audio direction parameters.

The at least one audio signal may comprise: multichannel loudspeaker audio signals; microphone array audio signals; ambisonic audio signals; mobile device capture audio signals; and transport audio signals.

According to a second aspect there is provided an apparatus comprising at least one processor and at least one memory including a computer program code, the at least one memory and the computer program code configured to, with the at least one processor, cause the apparatus at least to: receive at least one audio signal; retrieve/receive associated with the at least one audio signal over at least one frequency band a selection of at least one spatial audio energy ratio, and at least one remainder energy ratio; obtain at least one further ratio based on the selection of at least one spatial audio energy ratio, and at least one remainder energy ratio, the obtaining at least one further ration being based on determining subtracting a sum of the selection of at least one spatial audio energy ratio and at least one remainder energy ratio, and the at least one further ratio from a determined number, and wherein at least one output audio signal is rendered based on the at least one audio signal and on the selection of at least one spatial audio energy ratio and at least one remainder energy ratio and the obtained at least one further ratio.

The apparatus may be further caused to: obtain at least one spatial audio direction parameter associated with the at least one audio signal; obtain energies based on the at least one audio signal for the at least one frequency band; determine direct signal weights associated with the at least one spatial audio energy ratios related to the at least one spatial audio direction parameter; determine diffuse signal weights associated with the at least one spatial audio energy ratios unrelated to the at least one spatial audio direction parameter; distribute, based on the direct signal weights, a first part of the at least one audio signal associated with the at least one remainder energy ratio to a direct signal part associated with the at least one spatial audio direction parameter; distribute, based on the diffuse signal weights, a second part of the at least one audio signal associated with the at least one remainder energy ratio to a diffuse audio signal part; and render the at least one output signal based on the direct signal part and the diffuse signal part.

The apparatus may be further caused to: obtain at least one spatial audio direction parameter associated with the at least one audio signal; obtain energies based on the at least one audio signal for the at least one frequency band; determine direct signal weights associated with the at least one spatial audio energy ratios related to the at least one spatial audio direction parameter; select one of the at least one spatial audio direction parameters based on a largest direct signal weight value; obtain at least one spatial extent angle based on the selected one of the at least one spatial audio direction parameters; form at least one remainder audio signal part based on the at least one audio signal, the at least one remainder energy ratio, the selected one of the at least one spatial audio direction parameters and at least one spatial extent angle; and render the at least one output signal based on the at least one remainder audio signal part.

According to a third aspect there is provided an apparatus comprising at least one processor and at least one memory including a computer program code, the at least one memory and the computer program code configured to, with the at least one processor, cause the apparatus at least to: obtain at least one audio signal, at least one spatial audio direction parameter, at least one spatial audio energy ratio, the at least one spatial audio energy ratio comprising at least two of: at least one direct-to-total energy ratio associated with the at least one direction, at least one diffuse-to-total energy ratio and at least one remainder-to-total energy ratio; render at least one output audio signal based on the at least one audio signal, the at least one spatial audio direction parameter and the at least one spatial audio energy ratio, wherein the rendering is performed based on the at least one direct-to-total energy ratio associated with the at least one spatial audio direction parameter, the at least one diffuse-to-total energy ratio and the at least one remainder-to-total energy ratio.

The apparatus caused to render at least one output audio signal based on the at least one audio signal, the at least one spatial audio direction parameter and the at least one spatial audio energy ratio may be caused to: determine, associated with the at least one spatial audio direction parameter, the at least one direct-to-total energy ratio associated with the at least one direction, the at least one diffuse-to-total energy ratio and the at least one remainder-to-total energy ratio; distribute at least one remainder signal energy based on the at least one remainder-to-total energy ratio to a direct signal part and a diffuse signal part based on the direct-to-total energy ratio and diffuse-to-total energy ratio respectively.

The apparatus caused to render at least one output audio signals based on the at least one audio signal, the at least one spatial audio direction parameter and the at least one spatial audio energy ratio may be caused to: determine a spatial extent based on the direct-to-total energy ratio; and determine at least one remainder signal part based on the spatial extent and the at least one remainder-to-total energy ratio.

The apparatus may be further caused to: obtain at least one spatial audio direction parameter associated with the at least one audio signal; obtain energies based on the at least one audio signal for the at least one frequency band; determine direct signal weights based on the at least one direct-to-total energy ratio; determine diffuse signal weights based on the at least one diffuse-to-total energy ratio; distribute, based on the direct signal weights, a first part of the at least one audio signal associated with the at least one remainder-to-total energy ratio to a direct signal part associated with the at least one spatial audio direction parameter; distribute, based on the diffuse signal weights, a second part of the at least one audio signal associated with the at least one remainder-to-total energy ratio to a diffuse audio signal part; and render the at least one output signal based on the direct signal part and the diffuse signal part.

The apparatus may be further caused to: obtain energies based on the at least one audio signal for the at least one frequency band; determine direct signal weights based on the at least one direct-to-total energy ratio; select one of the at least one spatial audio direction parameters based on a largest direct signal weight value; obtain at least one spatial extent angle based on the selected one of the at least one spatial audio direction parameters; form at least one remainder audio signal part based on the at least one audio signal, the at least one remainder energy ratio, the selected one of the at least one spatial audio direction parameters and at least one spatial extent angle; and render the at least one output signal based on the at least one remainder audio signal part.

The apparatus may be further caused to: obtain at least one further energy ratio based on subtracting a sum of the at least one audio energy ratio from a determined number.

According to a fourth aspect there is provided a method comprising: receiving at least one audio signal; obtaining, associated with the at least one audio signal over at least one frequency band: at least one spatial audio energy ratio parameter; and at least one remainder energy ratio, wherein a sum of the at least one spatial audio energy ratio parameter and the at least one remainder energy ratio over the frequency band equal a determined value; and controlling a transmission/storage of the at least one spatial audio energy ratio, and the at least one remainder energy ratio.

The method may further comprise obtaining associated with the at least one audio signal over at least one frequency band at least one spatial audio direction parameter, wherein obtaining, associated with the at least one audio signal over at least one frequency band: at least one spatial audio energy ratio parameter; and at least one remainder energy ratio may further comprise obtaining: at least one first type energy ratio, wherein each of the at least one first type energy ratio may be associated with the at least one spatial audio direction parameter; and at least one second type energy ratio, wherein a sum of the at least one first type energy ratio, the at least one second type energy ratio and the at least one remainder energy ratio over the frequency band equal the determined value.

The at least one first type energy ratio may be at least one direct-to-total energy ratio and the at least one second type energy ratio may be at least one diffuse-to-total energy ratio.

Controlling a transmission/storage of the at least one spatial audio energy ratio, and the at least one remainder energy ratio may comprise selecting N−1 from a total N number of ratios to be transmitted/stored.

Selecting N−1 from a total N number of ratios to be transmitted/stored may comprise selecting N−1 from a total N number of ratios to be transmitted/stored based on an analysis of the at least one audio signal.

Selecting N−1 from a total N number of ratios to be transmitted/stored based on an analysis of the at least one audio signal may comprise performing at least one of: a long term classification; and a short term classification.

Controlling a transmission/storage of the at least one spatial audio energy ratio, and the at least one remainder energy ratio may comprise reducing a number of the at least one spatial audio energy ratio and at least one remainder energy ratio.

Reducing a number of the at least one spatial audio energy ratio and at least one remainder energy ratio may comprise: identifying at least one ratio based on a value of the ratio from: the at least one spatial audio energy ratio and/or at least one remainder energy ratio; either combining a value of the identified ratio with at least one other ratio of a same type, or compensating at least one ratio of a different type based on the value of the identified ratio.

Controlling a transmission/storage of the spatial audio energy ratio and the at least one remainder energy ratio may comprise: discarding at least one spatial audio direction parameter; distributing any first type energy ratio values associated with any discarded at least one spatial audio direction parameter among any first type energy ratios associated with any remaining spatial audio direction parameters and/or the second type energy ratios, wherein the distribution may be based on an angular difference between a remaining direction spatial audio direction parameters and the discarded spatial audio direction parameters.

The at least one audio signal may comprise: multichannel loudspeaker audio signals; microphone array audio signals; ambisonic audio signals; mobile device capture audio signals; and transport audio signals.

According to a fifth aspect there is provided a method comprising: receiving at least one audio signal; retrieving/receiving associated with the at least one audio signal over at least one frequency band a selection of at least one spatial audio energy ratio, and at least one remainder energy ratio; obtaining at least one further ratio based on the selection of at least one spatial audio energy ratio, and at least one remainder energy ratio, the obtaining at least one further ration being based on determining subtracting a sum of the selection of at least one spatial audio energy ratio and at least one remainder energy ratio, and the at least one further ratio from a determined number, and wherein at least one output audio signal is rendered based on the at least one audio signal and on the selection of at least one spatial audio energy ratio and at least one remainder energy ratio and the obtained at least one further ratio.

The method may comprise: obtaining at least one spatial audio direction parameter associated with the at least one audio signal; obtaining energies based on the at least one audio signal for the at least one frequency band; determining direct signal weights associated with the at least one spatial audio energy ratios related to the at least one spatial audio direction parameter; determining diffuse signal weights associated with the at least one spatial audio energy ratios unrelated to the at least one spatial audio direction parameter; distributing, based on the direct signal weights, a first part of the at least one audio signal associated with the at least one remainder energy ratio to a direct signal part associated with the at least one spatial audio direction parameter; distributing, based on the diffuse signal weights, a second part of the at least one audio signal associated with the at least one remainder energy ratio to a diffuse audio signal part; and rendering the at least one output signal based on the direct signal part and the diffuse signal part.

The method may further comprise: obtaining at least one spatial audio direction parameter associated with the at least one audio signal; obtaining energies based on the at least one audio signal for the at least one frequency band; determining direct signal weights associated with the at least one spatial audio energy ratios related to the at least one spatial audio direction parameter; selecting one of the at least one spatial audio direction parameters based on a largest direct signal weight value; obtaining at least one spatial extent angle based on the selected one of the at least one spatial audio direction parameters; forming at least one remainder audio signal part based on the at least one audio signal, the at least one remainder energy ratio, the selected one of the at least one spatial audio direction parameters and at least one spatial extent angle; and rendering the at least one output signal based on the at least one remainder audio signal part.

According to a sixth aspect there is provided a method comprising: obtaining at least one audio signal, at least one spatial audio direction parameter, at least one spatial audio energy ratio, the at least one spatial audio energy ratio comprising at least two of: at least one direct-to-total energy ratio associated with the at least one direction, at least one diffuse-to-total energy ratio and at least one remainder-to-total energy ratio; rendering at least one output audio signal based on the at least one audio signal, the at least one spatial audio direction parameter and the at least one spatial audio energy ratio, wherein the rendering is performed based on the at least one direct-to-total energy ratio associated with the at least one spatial audio direction parameter, the at least one diffuse-to-total energy ratio and the at least one remainder-to-total energy ratio.

Rendering at least one output audio signal based on the at least one audio signal, the at least one spatial audio direction parameter and the at least one spatial audio energy ratio may comprise: determining, associated with the at least one spatial audio direction parameter, the at least one direct-to-total energy ratio associated with the at least one direction, the at least one diffuse-to-total energy ratio and the at least one remainder-to-total energy ratio; distributing at least one remainder signal energy based on the at least one remainder-to-total energy ratio to a direct signal part and a diffuse signal part based on the direct-to-total energy ratio and diffuse-to-total energy ratio respectively.

Rendering at least one output audio signals based on the at least one audio signal, the at least one spatial audio direction parameter and the at least one spatial audio energy ratio may comprise: determining a spatial extent based on the direct-to-total energy ratio; and determining at least one remainder signal part based on the spatial extent and the at least one remainder-to-total energy ratio.

The method may further comprise: obtaining at least one spatial audio direction parameter associated with the at least one audio signal; obtaining energies based on the at least one audio signal for the at least one frequency band; determining direct signal weights based on the at least one direct-to-total energy ratio; determining diffuse signal weights based on the at least one diffuse-to-total energy ratio; distributing, based on the direct signal weights, a first part of the at least one audio signal associated with the at least one remainder-to-total energy ratio to a direct signal part associated with the at least one spatial audio direction parameter; distributing, based on the diffuse signal weights, a second part of the at least one audio signal associated with the at least one remainder-to-total energy ratio to a diffuse audio signal part; and rendering the at least one output signal based on the direct signal part and the diffuse signal part.

The method may further comprise: obtaining energies based on the at least one audio signal for the at least one frequency band; determining direct signal weights based on the at least one direct-to-total energy ratio; selecting one of the at least one spatial audio direction parameters based on a largest direct signal weight value; obtaining at least one spatial extent angle based on the selected one of the at least one spatial audio direction parameters; forming at least one remainder audio signal part based on the at least one audio signal, the at least one remainder energy ratio, the selected one of the at least one spatial audio direction parameters and at least one spatial extent angle; and rendering the at least one output signal based on the at least one remainder audio signal part.

The method may further comprise: obtaining at least one further energy ratio based on subtracting a sum of the at least one audio energy ratio from a determined number.

According to a seventh aspect there is provided an apparatus comprising means for: receiving at least one audio signal; obtaining, associated with the at least one audio signal over at least one frequency band: at least one spatial audio energy ratio parameter; and at least one remainder energy ratio, wherein a sum of the at least one spatial audio energy ratio parameter and the at least one remainder energy ratio over the frequency band equal a determined value; and controlling a transmission/storage of the at least one spatial audio energy ratio, and the at least one remainder energy ratio.

The means for may be further for: obtaining associated with the at least one audio signal over at least one frequency band at least one spatial audio direction parameter, wherein obtaining, associated with the at least one audio signal over at least one frequency band: at least one spatial audio energy ratio parameter; and at least one remainder energy ratio may be further for obtaining: at least one first type energy ratio, wherein each of the at least one first type energy ratio may be associated with the at least one spatial audio direction parameter; and at least one second type energy ratio, wherein a sum of the at least one first type energy ratio, the at least one second type energy ratio and the at least one remainder energy ratio over the frequency band equal the determined value.

The at least one first type energy ratio may be at least one direct-to-total energy ratio and the at least one second type energy ratio may be at least one diffuse-to-total energy ratio.

Controlling a transmission/storage of the at least one spatial audio energy ratio, and the at least one remainder energy ratio may be further for selecting N−1 from a total N number of ratios to be transmitted/stored.

Selecting N−1 from a total N number of ratios to be transmitted/stored may be further for selecting N−1 from a total N number of ratios to be transmitted/stored based on an analysis of the at least one audio signal.

Selecting N−1 from a total N number of ratios to be transmitted/stored based on an analysis of the at least one audio signal may be further for performing at least one of: a long term classification; and a short term classification.

Controlling a transmission/storage of the at least one spatial audio energy ratio, and the at least one remainder energy ratio may be further for reducing a number of the at least one spatial audio energy ratio and at least one remainder energy ratio.

Reducing a number of the at least one spatial audio energy ratio and at least one remainder energy ratio may be further for: identifying at least one ratio based on a value of the ratio from: the at least one spatial audio energy ratio and/or at least one remainder energy ratio; either combining a value of the identified ratio with at least one other ratio of a same type, or compensating at least one ratio of a different type based on the value of the identified ratio.

Controlling a transmission/storage of the spatial audio energy ratio and the at least one remainder energy ratio may be further for: discarding at least one spatial audio direction parameter; distributing any first type energy ratio values associated with any discarded at least one spatial audio direction parameter among any first type energy ratios associated with any remaining spatial audio direction parameters and/or the second type energy ratios, wherein the distribution may be based on an angular difference between a remaining direction spatial audio direction parameters and the discarded spatial audio direction parameters.

The at least one audio signal may comprise: multichannel loudspeaker audio signals; microphone array audio signals; ambisonic audio signals; mobile device capture audio signals; and transport audio signals.

According to an eighth aspect there is provided an apparatus comprising means for: receiving at least one audio signal; retrieving/receiving associated with the at least one audio signal over at least one frequency band a selection of at least one spatial audio energy ratio, and at least one remainder energy ratio; obtaining at least one further ratio based on the selection of at least one spatial audio energy ratio, and at least one remainder energy ratio, the obtaining at least one further ration being based on determining subtracting a sum of the selection of at least one spatial audio energy ratio and at least one remainder energy ratio, and the at least one further ratio from a determined number, and wherein at least one output audio signal is rendered based on the at least one audio signal and on the selection of at least one spatial audio energy ratio and at least one remainder energy ratio and the obtained at least one further ratio.

The means for may be further for: obtaining at least one spatial audio direction parameter associated with the at least one audio signal; obtaining energies based on the at least one audio signal for the at least one frequency band; determining direct signal weights associated with the at least one spatial audio energy ratios related to the at least one spatial audio direction parameter; determining diffuse signal weights associated with the at least one spatial audio energy ratios unrelated to the at least one spatial audio direction parameter; distributing, based on the direct signal weights, a first part of the at least one audio signal associated with the at least one remainder energy ratio to a direct signal part associated with the at least one spatial audio direction parameter; distributing, based on the diffuse signal weights, a second part of the at least one audio signal associated with the at least one remainder energy ratio to a diffuse audio signal part; and rendering the at least one output signal based on the direct signal part and the diffuse signal part.

The means for may be further for: obtaining at least one spatial audio direction parameter associated with the at least one audio signal; obtaining energies based on the at least one audio signal for the at least one frequency band; determining direct signal weights associated with the at least one spatial audio energy ratios related to the at least one spatial audio direction parameter; selecting one of the at least one spatial audio direction parameters based on a largest direct signal weight value; obtaining at least one spatial extent angle based on the selected one of the at least one spatial audio direction parameters; forming at least one remainder audio signal part based on the at least one audio signal, the at least one remainder energy ratio, the selected one of the at least one spatial audio direction parameters and at least one spatial extent angle; and rendering the at least one output signal based on the at least one remainder audio signal part.

According to a ninth aspect there is provided an apparatus comprising means for: obtaining at least one audio signal, at least one spatial audio direction parameter, at least one spatial audio energy ratio, the at least one spatial audio energy ratio comprising at least two of: at least one direct-to-total energy ratio associated with the at least one direction, at least one diffuse-to-total energy ratio and at least one remainder-to-total energy ratio; rendering at least one output audio signal based on the at least one audio signal, the at least one spatial audio direction parameter and the at least one spatial audio energy ratio, wherein the rendering is performed based on the at least one direct-to-total energy ratio associated with the at least one spatial audio direction parameter, the at least one diffuse-to-total energy ratio and the at least one remainder-to-total energy ratio.

Rendering at least one output audio signal based on the at least one audio signal, the at least one spatial audio direction parameter and the at least one spatial audio energy ratio may be further for: determining, associated with the at least one spatial audio direction parameter, the at least one direct-to-total energy ratio associated with the at least one direction, the at least one diffuse-to-total energy ratio and the at least one remainder-to-total energy ratio; distributing at least one remainder signal energy based on the at least one remainder-to-total energy ratio to a direct signal part and a diffuse signal part based on the direct-to-total energy ratio and diffuse-to-total energy ratio respectively.

Rendering at least one output audio signals based on the at least one audio signal, the at least one spatial audio direction parameter and the at least one spatial audio energy ratio may be further for: determining a spatial extent based on the direct-to-total energy ratio; and determining at least one remainder signal part based on the spatial extent and the at least one remainder-to-total energy ratio.

The means for may be further for: obtaining at least one spatial audio direction parameter associated with the at least one audio signal; obtaining energies based on the at least one audio signal for the at least one frequency band; determining direct signal weights based on the at least one direct-to-total energy ratio; determining diffuse signal weights based on the at least one diffuse-to-total energy ratio; distributing, based on the direct signal weights, a first part of the at least one audio signal associated with the at least one remainder-to-total energy ratio to a direct signal part associated with the at least one spatial audio direction parameter; distributing, based on the diffuse signal weights, a second part of the at least one audio signal associated with the at least one remainder-to-total energy ratio to a diffuse audio signal part; and rendering the at least one output signal based on the direct signal part and the diffuse signal part.

The means for may be further for: obtaining energies based on the at least one audio signal for the at least one frequency band; determining direct signal weights based on the at least one direct-to-total energy ratio; selecting one of the at least one spatial audio direction parameters based on a largest direct signal weight value; obtaining at least one spatial extent angle based on the selected one of the at least one spatial audio direction parameters; forming at least one remainder audio signal part based on the at least one audio signal, the at least one remainder energy ratio, the selected one of the at least one spatial audio direction parameters and at least one spatial extent angle; and rendering the at least one output signal based on the at least one remainder audio signal part.

The means for may be further for: obtaining at least one further energy ratio based on subtracting a sum of the at least one audio energy ratio from a determined number.

According to a tenth aspect there is provided a computer program comprising instructions [or a computer readable medium comprising program instructions] for causing an apparatus to perform at least the following: receiving at least one audio signal; obtaining, associated with the at least one audio signal over at least one frequency band: at least one spatial audio energy ratio parameter; and at least one remainder energy ratio, wherein a sum of the at least one spatial audio energy ratio parameter and the at least one remainder energy ratio over the frequency band equal a determined value; and controlling a transmission/storage of the at least one spatial audio energy ratio, and the at least one remainder energy ratio.

According to an eleventh aspect there is provided a computer program comprising instructions [or a computer readable medium comprising program instructions] for causing an apparatus to perform at least the following: receiving at least one audio signal; retrieving/receiving associated with the at least one audio signal over at least one frequency band a selection of at least one spatial audio energy ratio, and at least one remainder energy ratio; obtaining at least one further ratio based on the selection of at least one spatial audio energy ratio, and at least one remainder energy ratio, the obtaining at least one further ration being based on determining subtracting a sum of the selection of at least one spatial audio energy ratio and at least one remainder energy ratio, and the at least one further ratio from a determined number, and wherein at least one output audio signal is rendered based on the at least one audio signal and on the selection of at least one spatial audio energy ratio and at least one remainder energy ratio and the obtained at least one further ratio.

According to a twelfth aspect there is provided a computer program comprising instructions [or a computer readable medium comprising program instructions] for causing an apparatus to perform at least the following: obtaining at least one audio signal, at least one spatial audio direction parameter, at least one spatial audio energy ratio, the at least one spatial audio energy ratio comprising at least two of: at least one direct-to-total energy ratio associated with the at least one direction, at least one diffuse-to-total energy ratio and at least one remainder-to-total energy ratio; rendering at least one output audio signal based on the at least one audio signal, the at least one spatial audio direction parameter and the at least one spatial audio energy ratio, wherein the rendering is performed based on the at least one direct-to-total energy ratio associated with the at least one spatial audio direction parameter, the at least one diffuse-to-total energy ratio and the at least one remainder-to-total energy ratio.

According to a thirteenth aspect there is provided a non-transitory computer readable medium comprising program instructions for causing an apparatus to perform at least the following: receiving at least one audio signal; obtaining, associated with the at least one audio signal over at least one frequency band: at least one spatial audio energy ratio parameter; and at least one remainder energy ratio, wherein a sum of the at least one spatial audio energy ratio parameter and the at least one remainder energy ratio over the frequency band equal a determined value; and controlling a transmission/storage of the at least one spatial audio energy ratio, and the at least one remainder energy ratio.

According to a fourteenth aspect there is provided a non-transitory computer readable medium comprising program instructions for causing an apparatus to perform at least the following: receiving at least one audio signal; retrieving/receiving associated with the at least one audio signal over at least one frequency band a selection of at least one spatial audio energy ratio, and at least one remainder energy ratio; obtaining at least one further ratio based on the selection of at least one spatial audio energy ratio, and at least one remainder energy ratio, the obtaining at least one further ration being based on determining subtracting a sum of the selection of at least one spatial audio energy ratio and at least one remainder energy ratio, and the at least one further ratio from a determined number, and wherein at least one output audio signal is rendered based on the at least one audio signal and on the selection of at least one spatial audio energy ratio and at least one remainder energy ratio and the obtained at least one further ratio.

According to a fifteenth aspect there is provided a non-transitory computer readable medium comprising program instructions for causing an apparatus to perform at least the following: obtaining at least one audio signal, at least one spatial audio direction parameter, at least one spatial audio energy ratio, the at least one spatial audio energy ratio comprising at least two of: at least one direct-to-total energy ratio associated with the at least one direction, at least one diffuse-to-total energy ratio and at least one remainder-to-total energy ratio; rendering at least one output audio signal based on the at least one audio signal, the at least one spatial audio direction parameter and the at least one spatial audio energy ratio, wherein the rendering is performed based on the at least one direct-to-total energy ratio associated with the at least one spatial audio direction parameter, the at least one diffuse-to-total energy ratio and the at least one remainder-to-total energy ratio.

According to a sixteenth aspect there is provided a computer readable medium comprising program instructions for causing an apparatus to perform at least the following: receiving at least one audio signal; obtaining, associated with the at least one audio signal over at least one frequency band: at least one spatial audio energy ratio parameter; and at least one remainder energy ratio, wherein a sum of the at least one spatial audio energy ratio parameter and the at least one remainder energy ratio over the frequency band equal a determined value; and controlling a transmission/storage of the at least one spatial audio energy ratio, and the at least one remainder energy ratio.

According to a seventeenth aspect there is provided a computer readable medium comprising program instructions for causing an apparatus to perform at least the following: receiving at least one audio signal; retrieving/receiving associated with the at least one audio signal over at least one frequency band a selection of at least one spatial audio energy ratio, and at least one remainder energy ratio; obtaining at least one further ratio based on the selection of at least one spatial audio energy ratio, and at least one remainder energy ratio, the obtaining at least one further ration being based on determining subtracting a sum of the selection of at least one spatial audio energy ratio and at least one remainder energy ratio, and the at least one further ratio from a determined number, and wherein at least one output audio signal is rendered based on the at least one audio signal and on the selection of at least one spatial audio energy ratio and at least one remainder energy ratio and the obtained at least one further ratio.

According to an eighteenth aspect there is provided a computer readable medium comprising program instructions for causing an apparatus to perform at least the following: obtaining at least one audio signal, at least one spatial audio direction parameter, at least one spatial audio energy ratio, the at least one spatial audio energy ratio comprising at least two of: at least one direct-to-total energy ratio associated with the at least one direction, at least one diffuse-to-total energy ratio and at least one remainder-to-total energy ratio; rendering at least one output audio signal based on the at least one audio signal, the at least one spatial audio direction parameter and the at least one spatial audio energy ratio, wherein the rendering is performed based on the at least one direct-to-total energy ratio associated with the at least one spatial audio direction parameter, the at least one diffuse-to-total energy ratio and the at least one remainder-to-total energy ratio.

An apparatus comprising means for performing the actions of the method as described above.

An apparatus configured to perform the actions of the method as described above.

A computer program comprising program instructions for causing a computer to perform the method as described above.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

Figure 1:
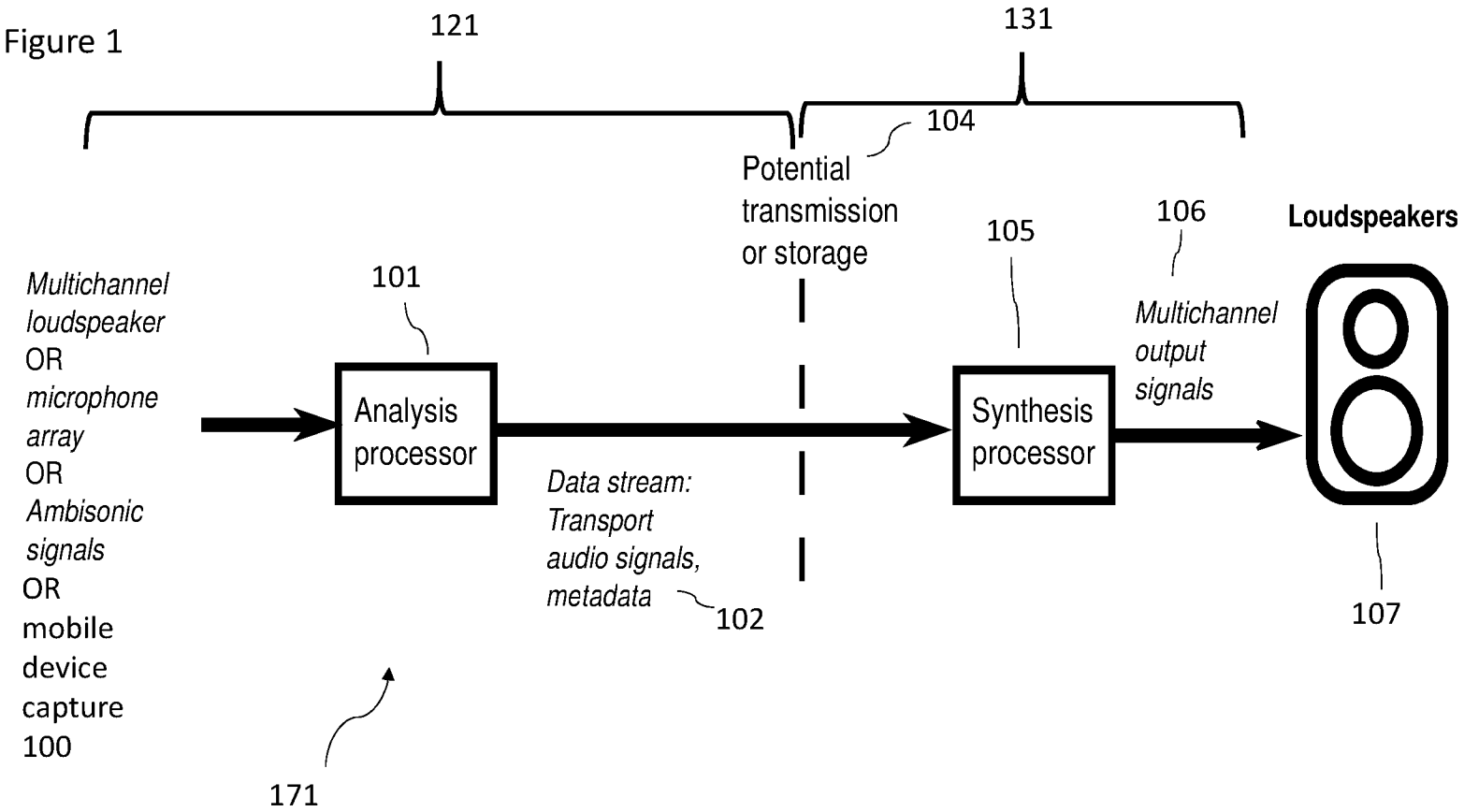
FIG. 1 shows schematically a system of apparatus suitable for implementing some embodiments.

The following describes in further detail suitable apparatus and possible mechanisms for the provision of effective spatial analysis derived metadata parameters associated with energy ratios for microphone array and other input format audio signals.

Apparatus has been designed to transmit a spatial audio modelling of a sound field using N (which is typically 2) transport audio signals and spatial metadata. The transport audio signals are typically compressed with a suitable audio encoding scheme (for example advanced audio coding—AAC or enhanced voice services—EVS codecs). The spatial metadata may contain parameters such as Direction (for example azimuth, elevation) in time-frequency domain.

Furthermore other parameters which may be determined and signalled to a renderer or receiver is one or more direct-to-total energy ratios (in the time-frequency domain) which represents the distribution of energy between each specific direction and the total audio energy. Another parameter may be one (or more where practical) diffuse-to-total energy ratio (in the time-frequency domain) which represents distribution of energy between ambient or diffuse signal (i.e., non-directional signal such as reverberation) and total energy.

A third energy related ratio parameter may be a remainder-to-total energy ratio (in the time-frequency domain) and is usually signalled implicitly, however it can at least in some embodiments be part of an audio format metadata being used as input to an audio codec. The remainder-to-total energy ratio represents the remaining energy after direct and diffuse energy contributions have been removed. This energy is formed by parts in the signal that are not produced by the actual sound scene. In other words this energy may be formed by parts in the signal that are not produced by the actual sound scene. For example, microphone and other system noise is part of this signal energy.

These ratios have the following relation:

$$r_{diff} + r_{rem} + \sum_{i=1}^{M} r_{dir}(i) = 1$$

where $r_{dir}(i)$ are the direct-to-total energy ratios, $r_{diff}$ is the diffuse-to-total energy ratio, $r_{rem}$ is the remainder energy ratio, i is the direction index, and M is the number of different directions in the metadata after a spatial analysis of the input audio signals.

In some embodiments, the total of sum may be other than 1.

It is also possible to use other similar sum relations for the combination of the ratios (e.g., sum of square roots of energy ratios), however the concept and the detailed description of the embodiments hereafter are expressed in the linear combination model in the knowledge that the corresponding (non-linear combination) equations are trivial to adapt for.

These ratios may be used within the renderer/synthesizer to form corresponding streams when applied to transport signals. For example in the synthesis operations the direct-to-total ratios form direct streams, diffuse-to-total ratio(s) form diffuse stream(s), and the remainder-to-total ratio forms a remainder stream. These may then be combined to generate the output audio.

In this modelling of the audio scene it is not assumed that all of the signal content is either direct or diffuse. The new model thus allows us to separate the signal to at least three streams of which direct and diffuse streams can be reproduced with a greater accuracy whereas the remainder signal is reproduced in a suitable way for each situation as described in the embodiments hereafter.

The determination of these ratios can be done with any suitable existing method.

This kind of parametrization may be denoted as sound-field related parametrization in the following disclosure. Using the direction and the direct-to-total energy ratio may be denoted as direction-ratio parameterization in the following disclosure. Further parameters may be used instead/in addition to these (e.g., diffuseness instead of direct-to-total-energy ratio, and adding a distance parameter to the direction parameter). Using such sound-field related parametrization, a spatial perception similar to that which would occur in the original sound field may be reproduced. As a result, the listener can perceive the multitude of sources, their directions and distances, as well as properties of the surrounding physical space, among the other spatial sound features.

The concept expressed hereafter in the embodiments is the provision of an efficient manner for signaling/storing the energy ratio information. In such a manner the signaling/storing of 'more' energy ratio parameters is controlled in such a manner that in some embodiments where the highest quality is desired, all of these parameters are delivered, but in circumstances where the audio codec functions at low bitrates then the parameters are optimized. Thus for example as discussed herein as there are three types of energy ratio parameters (of which one energy ratio from the three types can be implicitly signalled), the process of encoding these parameters is more complex.

For example where there are N ratios (where only N−1 ratios are needed in any transmission considering that the 1 ratio can be derived from the other transmitted ratios as the ratios are known to sum to a determined value, for example 1) the embodiments as discussed hereafter may be configured to select which N−1 ratios to encode and explicitly transmit to obtain a good quality output for example within any bandwidth/storage constraints set by the system or the use case. The N−1 ratios may then be used at a receiver to calculate the remaining 1 ratio.

In some embodiments it may be practical to store and/or transmit all N ratios. One such example is providing the N ratios in an audio format that may be used for example as an input format for an audio coding algorithm (or audio codec). For an input format it may be that there are no strict bandwidth constraints and providing all N ratios thus removes the need for the operations related to obtaining the N ratios in an encoder. Furthermore, it may be beneficial if the data is provided in a human-readable form to provide all N ratios. In general however it is understood that in most practical transmission systems (for example between an encoding and a decoding of a communications audio link) only N−1 ratios are transmitted in order to reduce the bandwidth. It is furthermore understood that in an audio format it can be provided N−1 ratios only.

In some embodiments a lossless compression may be employed. In such case the number of ratios transmitted may be irrelevant. This is thus one example of a transmission where all N ratios can be used. There can also be other examples.

Furthermore in some embodiments when the bandwidth bitrate/storage capacity is reduced to very low values the apparatus and methods described in further detail are configured to reduce the number of ratios (and directions) to reduce the amount of metadata transmitted/stored in a suitable manner so that minimal artefacts are introduced.

Solving this problem can be achieved with different strategies that reduce the transmitted energy ratios based on the requirements and parameter statistics.

In some embodiments as discussed in further detail herein the apparatus may be configured to select N−1 ratios from an available N streams. In such embodiments the selection may be a fixed selection or may be adaptive based at least on one classification of the audio signal (analysed over a time period or frame). The classification in some embodiments comprises a long-term classification (which covers for example active passages) and short-term classification (which covers at least the current audio frame and is configured to catch abrupt changes such as speech onsets). In some embodiments the classification can consider the time-frequency interval absolute signal energy in addition to the ratio parameters. This time-frequency interval absolute signal energy may be used for example to determine the perceptual significance of a spatial feature. In some embodiments an example classification used for selection of the N−1 streams from N streams is based on at least one of directional audio, diffuse audio, a mixture of directional/diffuse audio, or a fluctuation or combination of the two. In some examples classification is based on the noise characteristics of the audio signals. For example based on whether the audio signals have a low-level or have low signal to noise ratio (SNR). In some embodiments the classification of the audio signals may be based on application or encoder specific thresholds (typically involving perceptual tuning).

In some embodiments the number of used ratios may be reduced. For example where a certain ratio is very low, it may be grouped with another ratio in order to reduce the signalling bitrate/storage capacity required. Thus for example when the target bitrate is low the grouping allows the system to combine ratios together.

In some embodiments the diffuse-to-total ratio and remainder-to-total ratio are not selected to be transmitted/stored and direct-to-total ratios are compensated or modified based on this selection choice. In other words remove the remainder and diffuse separation. In some embodiments the direct-to-total-ratios are removed. In other words the remainder-to-total ratio is implicitly signalled in the direct-to-total-ratios.

Furthermore in some embodiments there may be only one implicit main direct-to-total ratio (that also contains remainder-to-total ratio) instead of multiple directions. In some further embodiments, the number of transmitted direct-to-total ratios may be adaptive, e.g., such that there may be only one implicit main direct-to-total ratio by default and there may be more than one direct-to-total ratio for frames where there is no diffuse sound (or the diffuseness is below a threshold).

In some embodiments, where there are low bitrate (storage/transmission) targets the apparatus and methods may be configured to reduce the number of directions and direct-to-total ratios. Thus as discussed herein there may be examples where only one "main" direction and its associated direct-to-total ratio parameter is encoded instead of all of the determined directions and the associated direct-to-total ratios. In such embodiments a main direction may be determined based on the largest weight (direct-to-total energy ratio*energy).

The direct-to-total ratio from any discarded/non-selected ratios may then be added to the remaining direct-to-total ratio or to the diffuse-to-total ratio. The distribution may be based on the angular difference between the main direction and the discarded direction. In such embodiments the closer the direction to main direction, the greater the proportion added to the direct-to-total ratio and the further from main direction, the greater the proportion added to the diffuse-to-total ratio.

In some embodiments the diffuse and direct portions are also combined.

Additionally the concept as discussed in further detail hereafter is one wherein reproduction of direct, diffuse and remainder streams are disclosed in such a manner that the remainder is treated as unwanted audio energy. Thus the remainder stream is not purely reproduced as either a direct signal, a diffuse signal, or as a coherent signal from all loudspeakers. Thus the embodiments prevent the situation occurring where the remainder stream is reproduced as direct when the total signal is mostly diffuse and therefore generates an unwanted noisy directional source. Similarly the embodiments prevent the remainder stream being reproduced as a pure diffuse signal when the total signal is a very dry direct signal and therefore prevents a creation of an additional noisy ambience that decreases the perceived "impact" of the direct signal. The embodiments prevent a coherent reproduction which present a noisy signal.

In some embodiments as discussed in further detail herein the reproduction of the remainder portion may be implemented so that it is effectively masked by or blended into other content.

Thus for example in some embodiments the renderer/synthesizer may be configured to reproduce the remainder signal energy so that it is masked by other signal energy. This may be implemented in some embodiments by estimating energy in all directions (for each frequency band) and distributing the remainder energy using direct and diffuse signal energy weights (direct/diffuse-to-total ratio multiplied with signal energy).

In some other embodiments a spatial extent for remainder energy may be determined. This may be implemented by selecting a main direction from the direct streams. Then determining a spatial extent dependent on direct and diffuse ratios. In examples where there is more direct component then the renderer may be configured to synthesize the remainder portion in the direction of main direction. In examples where there is more diffuse component then the renderer may be configured to synthesize the remainder portion all around with the determined extent.

With respect to FIG. 1 an example apparatus and system for implementing embodiments of the application are shown. The system 171 is shown with an 'analysis' part 121 and a 'synthesis' part 131. The 'analysis' part 121 is the part from receiving the input (multichannel loudspeaker, microphone array, ambisonics, or mobile device capture) audio signals 100 up to an encoding of the metadata and transport signal 102 which may be transmitted or stored 104. The 'synthesis' part 131 may be the part from a decoding of the encoded metadata and transport signal 104 to the presentation of the synthesized signal (for example in multi-channel loudspeaker form 106 via loudspeakers 107 or binaural or ambisonic formats).

The input to the system 171 and the 'analysis' part 121 is therefore audio signals 100. These may be suitable input multichannel loudspeaker audio signals, microphone array audio signals, ambisonic audio signals, or mobile captured audio signals.

The input audio signals 100 may be passed to an analysis processor 101. The analysis processor 101 may be configured to receive the input audio signals and generate a suitable data stream 104 comprising suitable transport signals. The transport audio signals may also be known as associated audio signals and be based on the audio signals. For example in some embodiments the transport signal generator 103 is configured to downmix or otherwise select or combine, for example, by beamforming techniques the input audio signals to a determined number of channels and output these as transport signals. In some embodiments the analysis processor is configured to generate a 2 audio channel output of the microphone array audio signals. The determined number of channels may be two or any suitable number of channels.

In some embodiments the analysis processor is configured to pass the received input audio signals 100 unprocessed to an encoder in the same manner as the transport signals. In some embodiments the analysis processor 101 is configured to select one or more of the microphone audio signals and output the selection as the transport signals 104. In some embodiments the analysis processor 101 is configured to apply any suitable encoding or quantization to the transport audio signals.

In some embodiments the analysis processor 101 is also configured to analyse the input audio signals 100 to produce metadata associated with the input audio signals (and thus associated with the transport signals). The analysis processor 101 can, for example, be a computer (running suitable software stored on memory and on at least one processor), mobile device, or alternatively a specific device utilizing, for example, FPGAs or ASICs. As shown herein in further detail the metadata may comprise, for each time-frequency analysis interval, at least one direction parameter and at least one energy ratio parameter. The at least one direction parameter and the at least one energy ratio parameter may in some embodiments be considered to be spatial audio parameters. In other words the spatial audio parameters comprise parameters which aim to characterize the sound-field of the input audio signals.

In some embodiments the parameters generated may differ from frequency band to frequency band and may be dependent on the transmission bit rate. Thus for example in band X all of the parameters are generated and transmitted, whereas in band Y only one of the parameters is generated and transmitted, and furthermore in band Z any other number of parameters are generated or transmitted. A practical example of this may be that for some frequency bands such as the highest band some of the parameters are not required for perceptual reasons.

The transport signals and the metadata 102 may be transmitted or stored, this is shown in FIG. 1 by the dashed line 104. Before the transport signals and the metadata are transmitted or stored they may in some embodiments be coded in order to reduce bit rate, and multiplexed to one stream. The encoding and the multiplexing may be implemented using any suitable scheme.

In the decoder side 131, the received or retrieved data (stream) may be input to a synthesis processor 105. The synthesis processor 105 may be configured to demultiplex the data (stream) to coded transport and metadata. The synthesis processor 105 may then decode any encoded streams in order to obtain the transport signals and the metadata.

The synthesis processor 105 may then be configured to receive the transport signals and the metadata and create a suitable multi-channel audio signal output 106 (which may be any suitable output format such as binaural, multichannel loudspeaker or Ambisonics signals, depending on the use case) based on the transport signals and the metadata. In some embodiments with loudspeaker reproduction, an actual physical sound field is reproduced (using the loudspeakers 107) having the desired perceptual properties. In other embodiments, the reproduction of a sound field may be understood to refer to reproducing perceptual properties of a sound field by other means than reproducing an actual physical sound field in a space. For example, the desired perceptual properties of a sound field can be reproduced over headphones using the binaural reproduction methods as described herein. In another example, the perceptual properties of a sound field could be reproduced as an Ambisonic output signal, and these Ambisonic signals can be reproduced with Ambisonic decoding methods to provide for example a binaural output with the desired perceptual properties.

The synthesis processor 105 can in some embodiments be a computer (running suitable software stored on memory and on at least one processor), mobile device, or alternatively a specific device utilizing, for example, FPGAs or ASICs.

Figure 2:
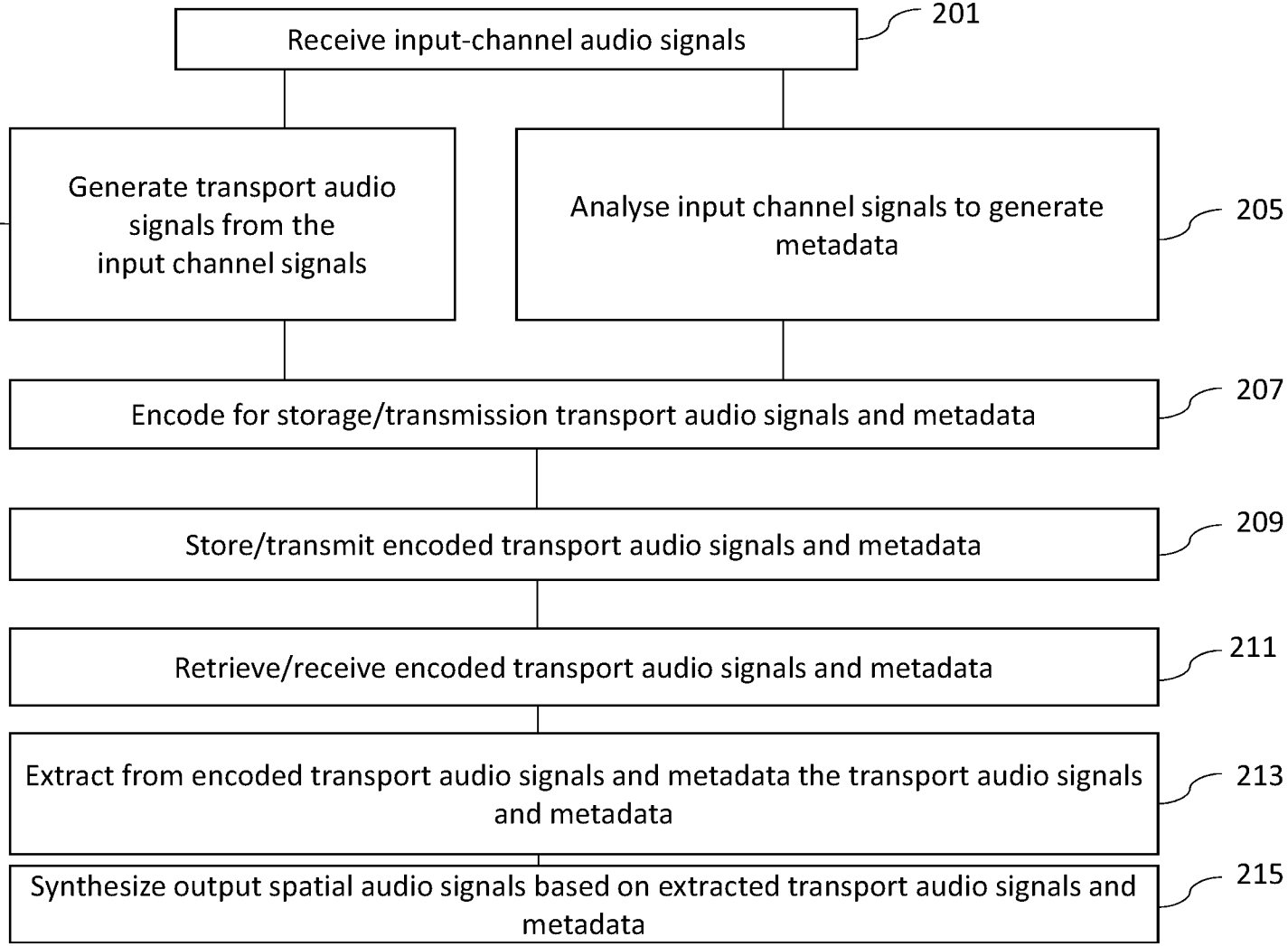
FIG. 2 shows a flow diagram of the operation of the system as shown in FIG. 1 according to some embodiments.

With respect to FIG. 2 an example flow diagram of the overview shown in FIG. 1 is shown.

First the system (analysis part) is configured to receive input audio signals or suitable multichannel input as shown in FIG. 2 by step 201.

Then the system (analysis part) is configured to generate a transport signal channels or transport signals (for example downmix/selection/beamforming based on the multichannel input audio signals) as shown in FIG. 2 by step 203.

Also the system (analysis part) is configured to analyse the audio signals to generate metadata: Directions; Energy ratios as shown in FIG. 2 by step 205.

The system is then configured to (optionally) encode for storage/transmission the transport signals and metadata as shown in FIG. 2 by step 207.

After this the system may store/transmit the transport signals and metadata as shown in FIG. 2 by step 209.

The system may retrieve/receive the transport signals and metadata as shown in FIG. 2 by step 211.

Then the system is configured to extract from the transport signals and metadata as shown in FIG. 2 by step 213.

The system (synthesis part) is configured to synthesize an output spatial audio signals (which as discussed earlier may be any suitable output format such as binaural, multichannel loudspeaker or Ambisonics signals, depending on the use case) based on extracted audio signals and metadata as shown in FIG. 2 by step 215.

Figure 3:
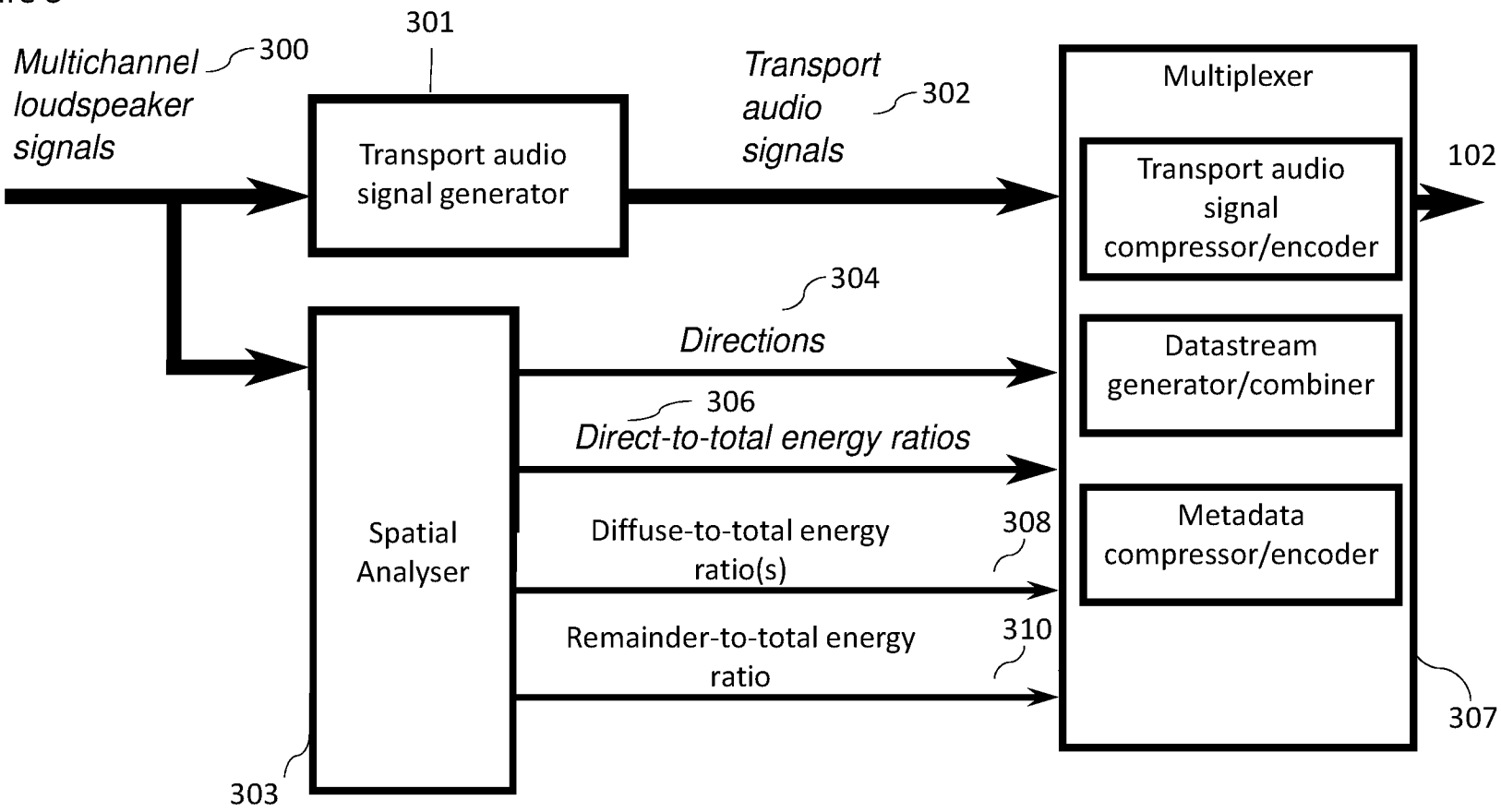
FIG. 3 shows schematically capture/encoding apparatus suitable for implementing some embodiments.

With respect to FIG. 3 an example analysis processor 101 according to some embodiments where the input audio signal is a multichannel loudspeaker input is shown. The multichannel loudspeaker signals 300 in this example are passed to a transport audio signal generator 301. The transport audio signal generator 301 is configured to generate the transport audio signals according to any of the options described previously. For example the transport audio signals may be downmixed from the input signals. The number of the transport audio signals may be any number and may be 2 or more or fewer than 2.

In the example shown in FIG. 3 the multichannel loudspeaker signals 300 are also input to a spatial analyser 303. The spatial analyser 303 may be configured to generate suitable spatial metadata outputs such as shown as the directions 304, (a first type of energy ratios) direct-to-total energy ratios 306, (a second type of energy ratios) diffuse-to-total energy ratio(s) 308, and (a third type of energy ratios) remainder-to-total energy ratio(s) 310. The implementation of the analysis may be any suitable implementation that produces the described metadata outputs.

The analysis processor may further comprise a multiplexer 307 configured to combine and encode the transport audio signals 302, the directions 304, the direct-to-total energy ratios 306 and other ratios to generate the data stream 102.

For example the multiplexer may comprise a suitable transport audio signals compressor/encoder. For example the multiplexer 307 may be configured to compress the audio signals using a suitable codec (e.g., AAC or EVS). The multiplexer may comprise a suitable metadata compressor/encoder configured to compress the metadata as described herein in further detail. In some embodiments the multiplexer 307 is furthermore configured to attempt to combine the compressed metadata and audio signals to generate the data stream 102 to be transmitted/stored.

Figure 4:
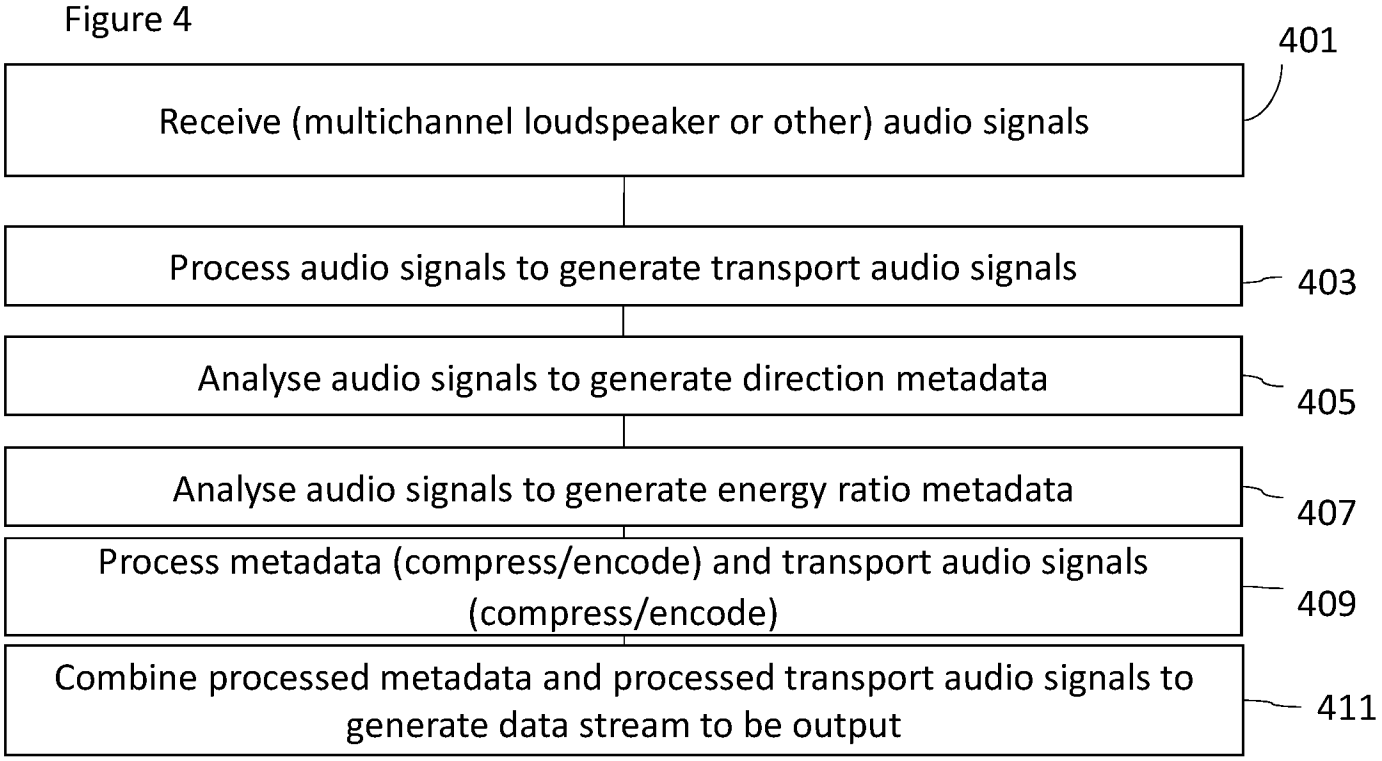
FIG. 4 shows a flow diagram of the operation of capture/encoding apparatus as shown in FIG. 3 according to some embodiments.

With respect to FIG. 4 is shown a flow diagram of the operation of the analysis processor.

The first operation is one of receiving the (multichannel loudspeaker or other) audio signals as shown in FIG. 4 by step 401.

In some embodiments the audio signals are processed in some form to generate the transport audio signals as shown in FIG. 4 by step 403.

The following operation may be one of spatially analysing the (multichannel loudspeaker) signals in order to determine direction metadata as shown in FIG. 4 by step 405.

Then the energy ratios (for example the direct, diffuse and remainder energy ratios) are determined as shown in FIG. 4 by step 407.

In some embodiments the metadata and transport audio signals are processed (compressed/encoded). For example the number of the directions and ratios are furthermore controlled (and may be selected and/or combined). The processing of the metadata/transport audio signals is shown in FIG. 4 by step 409.

The processed transport audio signals and the metadata may then be furthermore be combined to generate a suitable data stream as shown in FIG. 4 by step 411.

Figure 5:
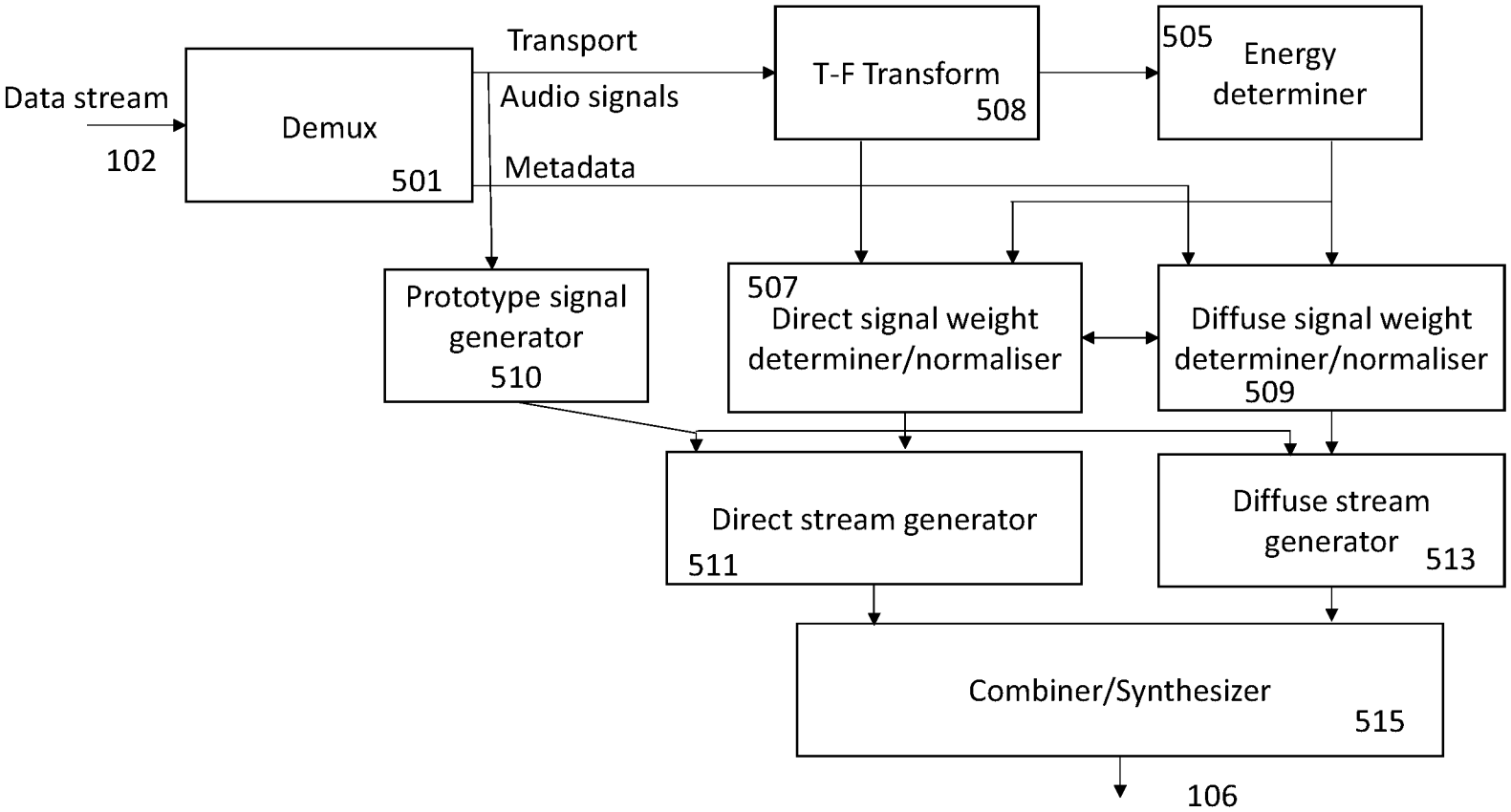
FIG. 5 shows schematically rendering apparatus implementing spatial and spectral remainder based signal generation suitable for implementing some embodiments.

With respect to FIG. 5 there is shown an example synthesis processor 105 suitable for processing the output of the multiplexer according to some embodiments. In this example the following steps are implemented to process the remainder components:

Obtain transport audio signals and perform a time-frequency transform on the transport audio signals;

Obtain ratio values for each frequency band (from the decoded metadata);

Calculate frequency band energies;

Calculate directional signal energy weights for each frequency band;

Calculate diffuse signal energy weights for each frequency band;

Distribute part of the remainder signal energy into the metadata directions using the corresponding directional signal energy weights; and Distribute part of remainder signal energy into all directions using the diffuse signal energy weights.

The synthesis processor 105 as shown in FIG. 5 shows a de-multiplexer 501. The de-multiplexer 501 is configured to receive the data stream 102 and de-multiplex and/or decompress or decode the transport audio signals and the metadata.

The transport audio signals may then be output to a suitable time-frequency domain transformer (for example a filterbank or a STFT or complex QMF). The time-frequency domain transformer 508 may be configured to perform a time-frequency transform and therefore generate a suitable time-frequency representation of the transport audio signals.

These time-frequency representations may then be passed to an energy determiner 505. The energy determiner 505 may be configured to generate energy calculations in frequency bands associated with the frequency bands in which the metadata is divided into.

The signal energies can for example be determined with the following equation:

$$E = \frac{1}{TKC}\sum_{n=1}^{T}\sum_{k=K_b}^{K_t}\sum_{c=1}^{C}|S(c,k,n)|^2$$

where T is number of time samples in this time frame, $K_b$ and $K_t$ are the current frequency band bottom and top frequency bins, and C is the number of input channels in the signal. S(c,k,n) is the time-frequency domain representation of the transport signal.

The synthesis processor further comprises a direct signal weight determiner/normaliser 507. The direct signal weight determiner/normaliser 507 is configured to receive the energy values from the energy determiner 505 and the direct-to-total energy ratios (or a similar direct based energy value) from the de-multiplexer 501. The directional signal energy weights may be determined based on the following equation:

$$w_{dir}(i,k)=r_{dir}(i,k)*E(k)$$

where i is the direction index, k is the frequency band index, $r_{dir}(i, k)$ signifies direct-to-total energy ratios for each direction and frequency band and E(k) is the energy for each frequency band.

The synthesis processor further comprises a diffuse signal weight determiner/normaliser 509. The diffuse signal weight determiner/normaliser 509 is configured to receive the energy values from the energy determiner 505 and the diffuse-to-total energy ratios (or a similar diffuse based energy value) from the de-multiplexer 501. The diffuse signal energy weights may be determined based on the following equation:

$$w_{diff}(j,k)=r_{diff}(j,k)*E(k)$$

where j is the diffuse index, k is the frequency band index, $r_{diff}(j, k)$ is the diffuse-to-total energy ratios for each frequency band, and E(k) is the energy for each frequency band.

In some embodiments, where there is only one diffuse-to-total energy ratio then the diffuse signal energy weights may be determined using the following equation:

$$w_{diff}(k)=r_{diff}(k)*E(k)$$

In other words the diffuse index j may be ignored or set to 1. This may then be propagated in the following method.

In some embodiments the direct and diffuse signal weight determiners/normalisers 507, 509 are further configured to respectively scale the weights so that they total sum of one (in other words normalise the weights). This may be achieved, for example, by applying the following equations.

$$w_{\text{dir_norm}}(i,k)=\frac{w_{dir}(i,k)}{\sum_{j=1}^{J} w_{diff}(j,k)+\sum_{m=1}^{M} w_{dir}(m,k)}$$

$$w_{\text{diff_norm}}(j,k)=\frac{w_{diff}(j,k)}{\sum_{j=1}^{J} w_{diff}(j,k)+\sum_{m=1}^{M} w_{dir}(m,k)}$$

In the single diffuse-to-total ratio example the scaling may be defined as $$w_{\text{dir_norm}}(i,k)=\frac{w_{dir}(i,k)}{w_{diff}(k)+\sum_{m=1}^{M} w_{dir}(m,k)}$$

$$w_{\text{diff_norm}}(k)=\frac{w_{diff}(k)}{w_{diff}(k)+\sum_{m=1}^{M} w_{dir}(m,k)}$$

In some embodiments the synthesis processor comprises a prototype signal generator 510. The prototype signal generator 510 is configured to generate prototype signals for synthesis from the transport signals using a suitable algorithm. For example, if the transport signals contains two channels of stereo, left and right, the prototype signals are generated so that directions synthesized to the left use the left channel, directions synthesized to the right use the right channel, and directions synthesized to the centre use a downmix of these two channels. Similar algorithms can be formed for any transport signal format.

In some embodiments the synthesis processor further comprises a direct stream generator 511 and diffuse stream generator 513. The direct stream generator 511 and the diffuse stream generator 513 are configured to generate respective direct and diffuse based audio streams. This may be implemented as a two stage process. First a set of interim signals are generated from the prototype signals $s_p(k)$ and the direct-to-total $r_{dir}(i, k)$, diffuse-to-total $r_{diff}(i, k)$ and remainder $r_{rem}(k)$ energy ratios using the following equations:

$$s_{dir}(i,k)=s_p(k)*\sqrt{r_{\text{dir}}(i,k)}$$

$$s_{diff}(j,k)=s_p(k)*\sqrt{r_{\text{diff}}(j,k)}$$

$$s_{rem}(k)=s_p(k)*\sqrt{r_{\text{rem}}(k)}$$

From these interim signals then the final direct and diffuse streams may be generated based on the following equations:

$$s_{dir_final}(i,k)=s_{dir}(i,k)+s_{rem}(k)*\sqrt{w_{\text{dir_norm}}(i,k)}$$

$$s_{diff_final}(i,k)=s_{diff}(i,k)+s_{rem}(k)*\sqrt{w_{\text{diff_norm}}(j,k)}$$

The output of the direct stream generator 511 and the diffuse stream generator 513 may then be passed to the spatial combiner/synthesizer 515.

The synthesis processor may further comprise a spatial combiner/synthesizer 515 configured to receive the direct and diffuse streams and based on these generate a suitable audio signal output. The spatial combiner/synthesizer 515 may be configured to apply any suitable spatial synthesis operation or method in order to generate the output audio signals. Similarly the output audio signals may be any suitable audio signal format (binaural, multichannel loudspeaker, first and/or higher order ambisonic audio signals, etc.)

In some embodiments it may be possible to implement the operations above in time domain. In such embodiments the energy values may be calculated as wideband values and applied similarly to all frequency bands.

In some embodiments the weight calculations can also be performed in any suitable manner and the above is just an example. For example, the weights can be purely the corresponding energy ratios for more efficient processing.

As the remainder signal can contain signal components that are not well reproduced through a decorrelation filter bank that is often used in diffuse signal synthesis, in some embodiments the remainder-to-total ratio are only distributed to the direct-to-total ratios while preserving the condition that sum of energy ratios is 1 (or other defined value). This would avoid generating artefacts but also makes the remainder part more directional.

Figure 6:
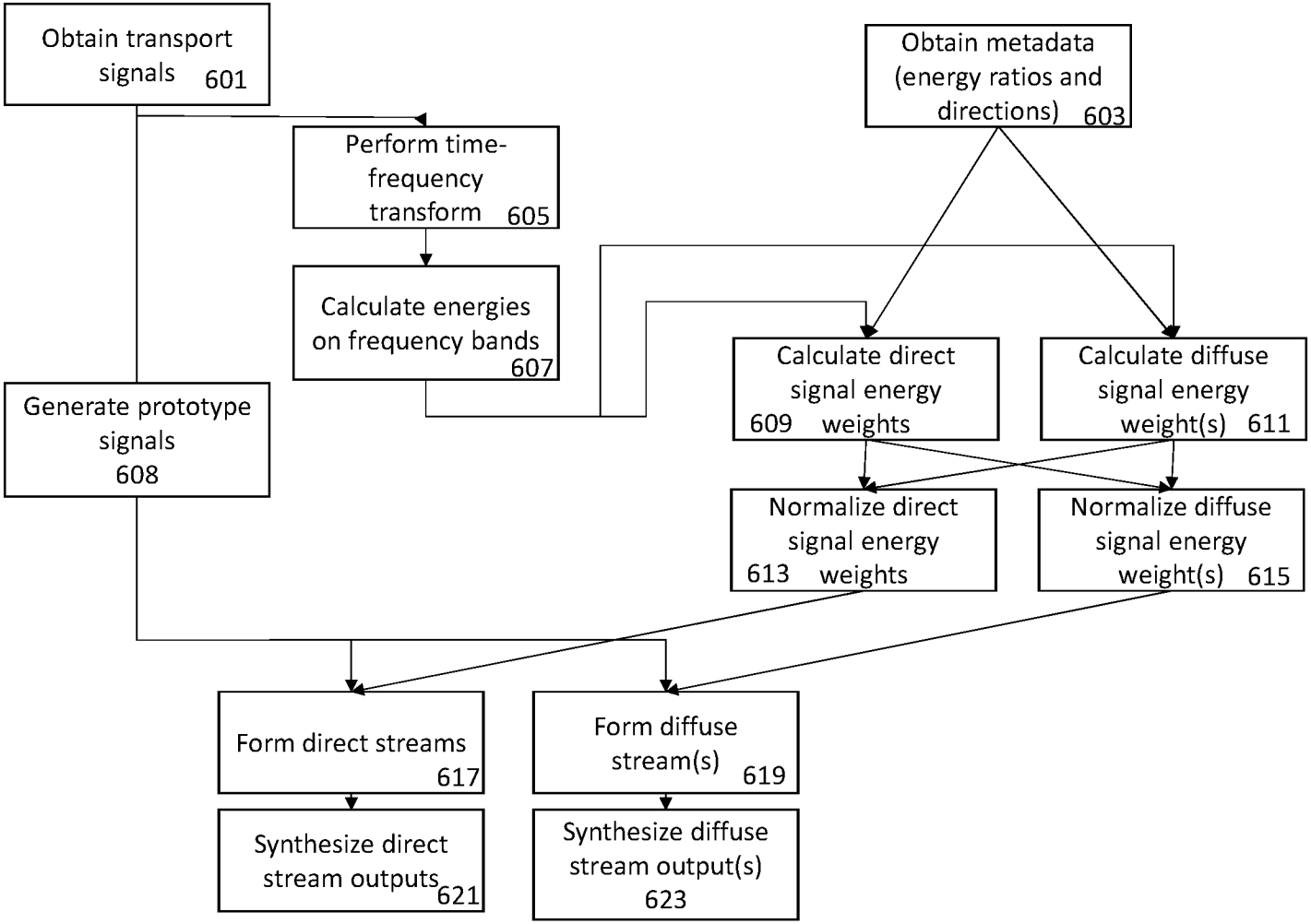
FIG. 6 shows a flow diagram of the operation of the rendering apparatus spatial and spectral remainder based signal generation shown in FIG. 5 according to some embodiments.

With respect to FIG. 6 a flow diagram showing the operations of the synthesis processor as shown in FIG. 5.

An operation is obtaining the transport audio signals from the data-stream as shown in FIG. 6 by step 601.

A further operation is obtaining the metadata (the direction and energy ratios) from the data-stream as shown in FIG. 6 by step 603.

Having obtained the transport audio signals a time-frequency transform may be performed on the transport audio signals as shown in FIG. 6 by step 605.

From the time-frequency transformed transport audio signals the energy on frequency bands may be determined as shown in FIG. 6 by step 607.

The direct signal energy weights may then be determined based on the energy values and the direct-to-total energy ratios as shown in FIG. 6 by step 609.

The diffuse signal energy weights may then be determined based on the energy values and the diffuse-to-total energy ratios as shown in FIG. 6 by step 611.

The normalised direct signal energy weights may then be determined based on the direct signal energy weights and the diffuse signal energy weights as shown in FIG. 6 by step 613.

Furthermore the normalised diffuse signal energy weights may then be determined based on the direct signal energy weights and the diffuse signal energy weights as shown in FIG. 6 by step 615.

Prototype signals may then be generated from the transport audio signals as shown in FIG. 6 by step 608.

The direct streams may then be formed based on the normalised direct signal energy weights and the prototype audio signals as shown in FIG. 6 by step 617.

The direct stream outputs may then be synthesized based on the formed direct streams as shown in FIG. 6 by step 621.

The diffuse streams may then be formed based on the normalised diffuse signal energy weights and the transport audio signals as shown in FIG. 6 by step 619.

The diffuse stream outputs may then be synthesized based on the formed diffuse streams as shown in FIG. 6 by step 623.

Figure 7:
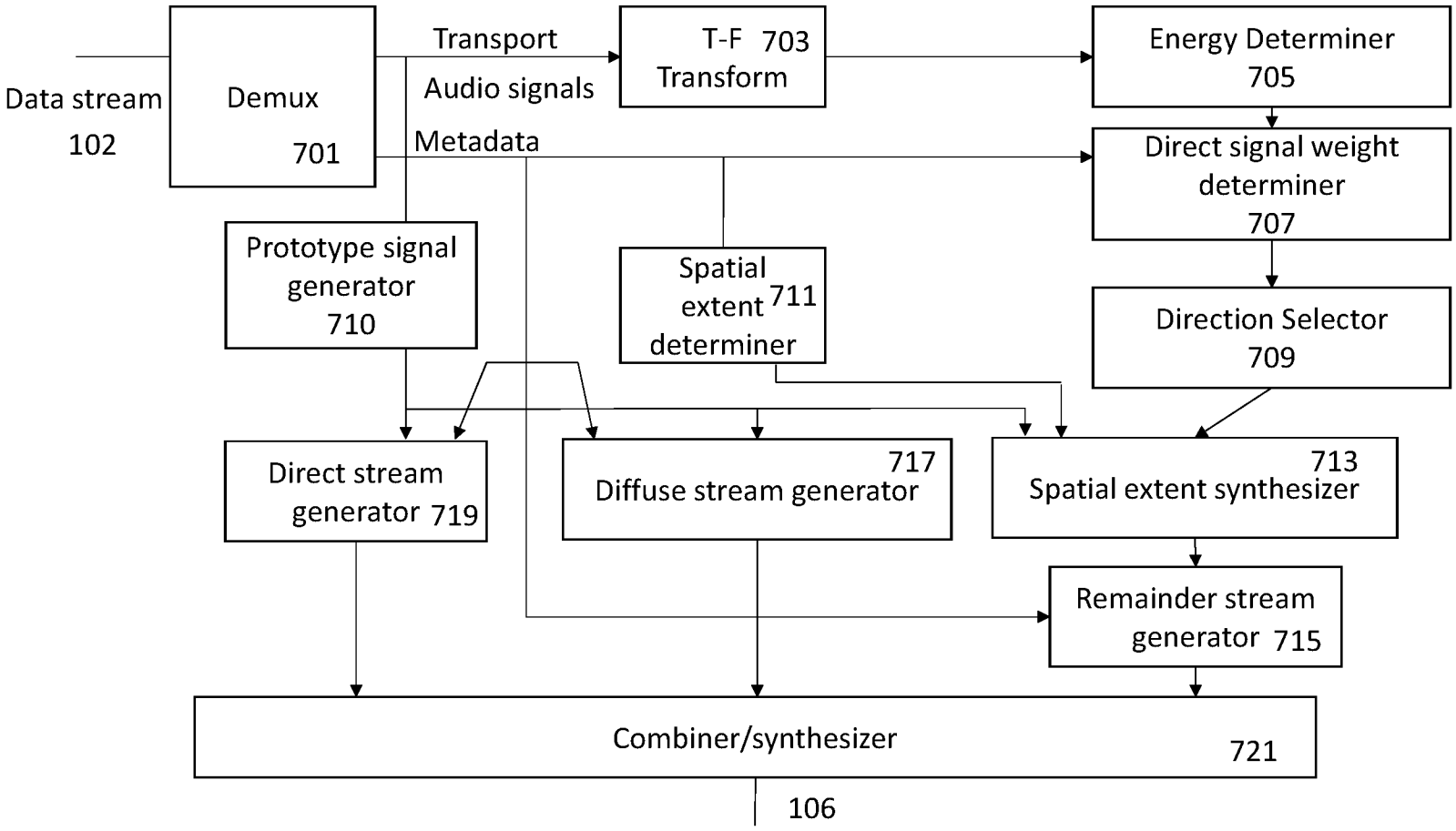
FIG. 7 shows schematically rendering apparatus implementing spatial extent based remainder signal generation suitable for implementing some embodiments.

With respect to FIG. 7 is shown a further example synthesis processor. This example synthesis processor renders the remainder signal by applying spatial extent processing to it. Therefore instead of rendering the remainder signal as part of direct and diffuse signals as in the example shown in FIGS. 5 and 6 spatial extent synthesis processing is applied to distribute the frequency bands of the signal to different directions. This may therefore distribute the energy to a specific spatial extent area so that no clear direction for it can be perceived.

Thus in summary the synthesis processor may be configured to:

Obtain transport audio signals and perform time-frequency transform on the transport audio signals to obtain a time-frequency representation;

Obtain ratio values for each frequency band (from decoded metadata);

Calculate frequency band energies;

Select or determine a main direction of spatial extent from the most significant direction component;

Form a spatial extent angle based on the relation of the main direction ratio; and Synthesize a remainder signal using the spatial extent.

The synthesis processor 105 as shown in FIG. 7 shows a de-multiplexer 701. The de-multiplexer 701 is configured to receive the data stream 102 and de-multiplex and/or decompress or decode the transport audio signals and the metadata.

The transport audio signals may then be output to a suitable time-frequency domain transformer 703 (for example a filterbank or a STFT or complex QMF). The time-frequency domain transformer 703 may be configured to perform a time-frequency transform and therefore generate a suitable time-frequency representation of the transport audio signals.

These time-frequency representations may then be passed to an energy determiner 705. The energy determiner 705 may be configured to generate energy calculations in frequency bands associated with the frequency bands in which the metadata is divided into.

The signal energies can for example be determined with the following equation:

$$E = \frac{1}{TKC}\sum_{n=1}^{T}\sum_{k=K_b}^{K_t}\sum_{c=1}^{C}|S(c,k,n)|^2$$

where T is number of time samples in this time frame, $K_b$ and $K_t$ are the current frequency band bottom and top frequency bins, and C is the number of input channels in the signal. S(c,k,n) is the time-frequency domain representation of the transport signal.

The synthesis processor further comprises a direct signal weight determiner 707. The direct signal weight determiner 707 is configured to receive the energy values from the energy determiner 705 and the direct-to-total energy ratios (or a similar direct based energy value) from the de-multiplexer 701. The directional signal energy weights may be determined based on the following equation:

$$w_{dir}(i,k)=r_{dir}(i,k)*E(k)$$

where i is the direction index, k is the frequency band index, $r_{dir}$ (i, k) signifies direct-to-total energy ratios for each direction and frequency band and E(k) is the energy for each frequency band.

The synthesis processor may further comprise a direction selector 709. The direction selection 709 is configured to select the direction with the largest weight as the main direction.

The synthesis processor may comprise a spatial extent determiner 711. The spatial extent determiner 711 is configured to generate a spatial extent angle based on the direct-to-total energy ratio. For example in some embodiments the spatial extent determiner may generate the spatial extent angle based on:

$$\varphi_{extent} = \left(1 - \frac{r_{\text{dir_main}}}{r_{diff} + \sum_{i=1}^{M} r_{dir}}\right)^{p} * 360^{\circ}$$

Here p is an exponential tuning parameter that can be, e.g., 1 or 0.5 depending on the curve that is desired. Furthermore, $\varphi_{extent}$ is assumed to represent the "opening angle", i.e., 0° would be no extent, 180° would cover half-circle or half-sphere and 360° is a full circle or full sphere.

The synthesis processor may comprise a prototype signal generator 710 configured to generate suitable prototype signals from the transport audio signals in a manner similar to that described herein.

In some embodiments the synthesis processor may comprise a spatial extent synthesizer 713 and remainder stream generator 715. The spatial extent synthesizer 713 and remainder stream generator 715 is configured to synthesize the remainder signal as spatial extent using any suitable known spatial extent synthesis algorithm based on the prototype audio signals, spatial extent angle and spatial extent direction (the output from the direction selector).

The synthesis processor may further comprise a direct stream generator 719 and diffuse stream generator 717. The direct stream generator 719 and the diffuse stream generator 717 are configured to generate respective direct and diffuse based audio streams. These may be generated from the prototype signals $s_p$(k) and the direct-to-total ratios $r_{dir}$(i, k) and diffuse-to-total ratios $r_{diff}$(j,k) using the following equations:

$$s_{dir}(i,k)=s_p(k)*\sqrt{r_{\text{dir}}(i,k)}$$

$$s_{diff}(i,k)=s_p(k)*\sqrt{r_{\text{diff}}(i,k)}$$

or $$s_{diff}(k)=s_p(k)*\sqrt{r_{\text{diff}}(k)}$$

For the single diffuse-to-total energy ratio example.

The synthesis processor may further comprise a spatial combiner/synthesizer 721 configured to receive the direct, diffuse and remainder streams and based on these generate a suitable audio signal output. The spatial combiner/synthesizer 721 may be configured to apply any suitable spatial synthesis operation or method in order to generate the output audio signals. Similarly the output audio signals may be any suitable audio signal format (binaural, multichannel loudspeaker, first and/or higher order ambisonic audio signals, etc.).

In some embodiments it may be possible to form the main direction as the signal-energy-weight-based average. In these embodiments the spatial extent angle should be created using $(1-r_{diff})$ as the ratio.

Figure 8:
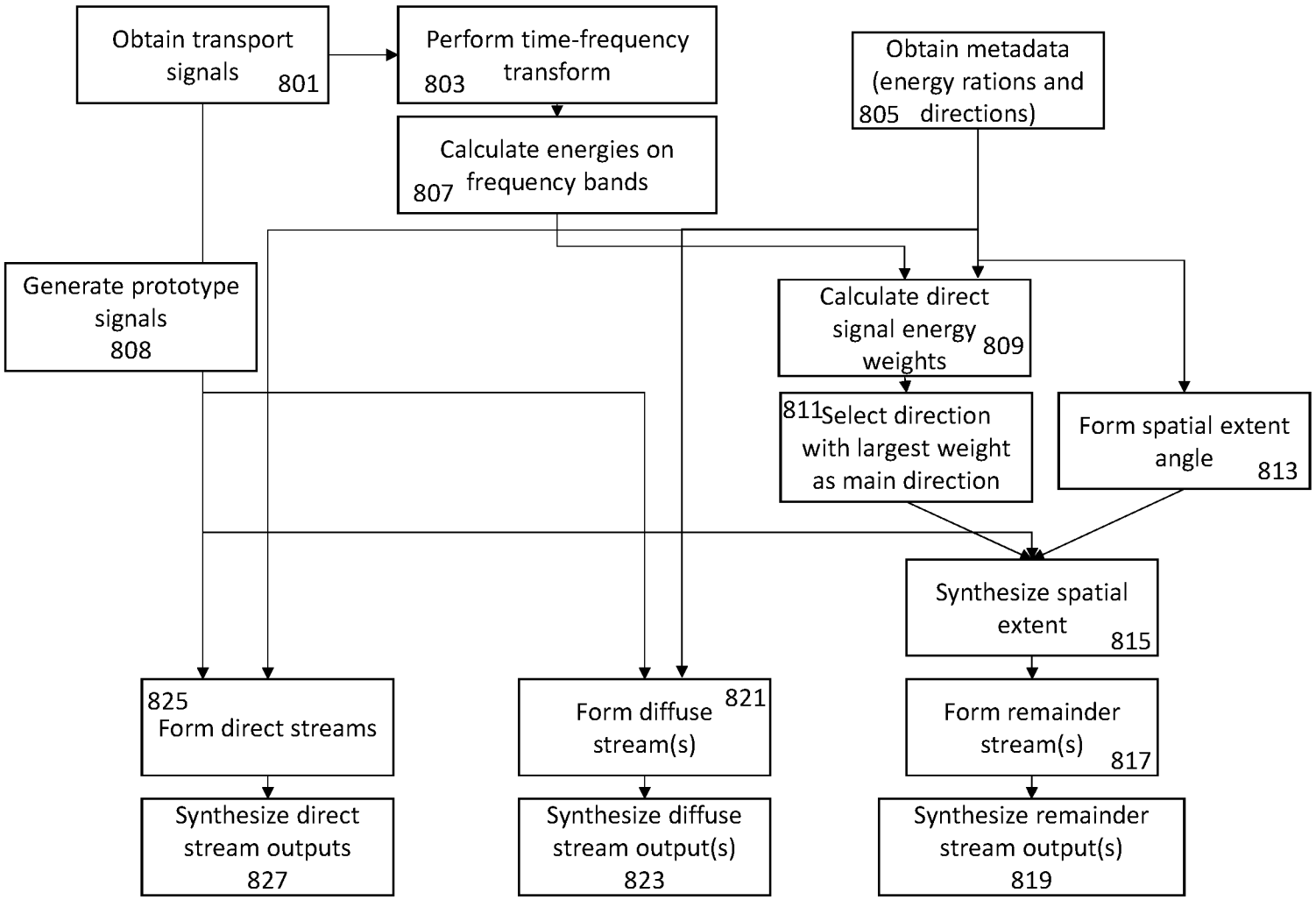
FIG. 8 shows a flow diagram of the operation of the rendering apparatus implementing spatial extent based remainder signal generation shown in FIG. 7 according to some embodiments.

With respect to FIG. 8 a flow diagram showing the operations of the synthesis processor as shown in FIG. 7.

An operation is obtaining the transport audio signals from the data-stream as shown in FIG. 8 by step 801.

A further operation is obtaining the metadata (the direction and energy ratios) from the data-stream as shown in FIG. 8 by step 805.

Having obtained the transport audio signals a time-frequency transform may be performed on the transport audio signals as shown in FIG. 8 by step 803.

From the time-frequency transformed transport audio signals the energy on frequency bands may be determined as shown in FIG. 8 by step 807.

The direct signal energy weights may then be determined based on the energy values and the direct-to-total energy ratios as shown in FIG. 8 by step 809.

The selection of the main direction based on the largest weight is shown in FIG. 8 by step 811.

The forming of the spatial extent angle is shown in FIG. 8 by step 813.

Prototype signals may then be generated as shown in FIG. 8 by step 808.

The spatial extent is formed based on the prototype audio signals, spatial extent angle and main direction is shown in FIG. 8 by step 815.

A remainder stream is then formed based on the spatial extent is shown in FIG. 8 by step 817.

Then remainder stream outputs are synthesized as shown in FIG. 8 by step 819.

The direct streams may then be formed based on the direct-to-total energy ratios and the prototype audio signals as shown in FIG. 8 by step 825.

The direct stream outputs may then be synthesized based on the formed direct streams as shown in FIG. 8 by step 827.

The diffuse streams may then be formed based on the diffuse-to-total energy ratio and prototype audio signals as shown in FIG. 8 by step 821.

The diffuse stream outputs may then be synthesized based on the formed diffuse streams as shown in FIG. 8 by step 823.

Figure 9B:
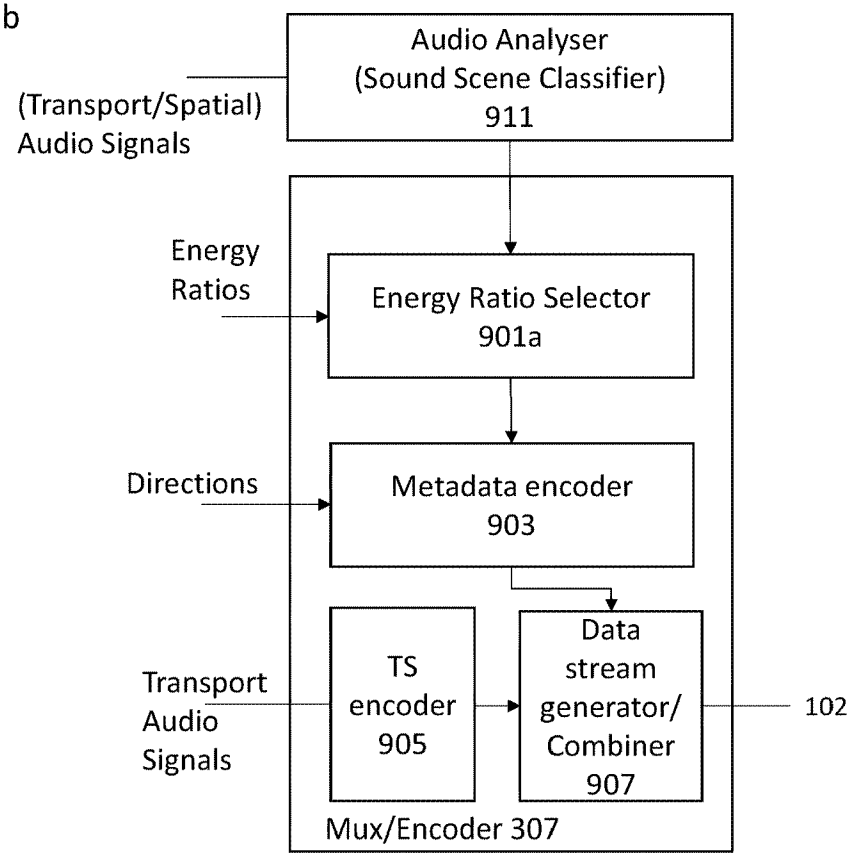
FIGS. 9*a* and 9*b* show schematically energy ratio signalling apparatus according to some embodiments.
Figure 9A:
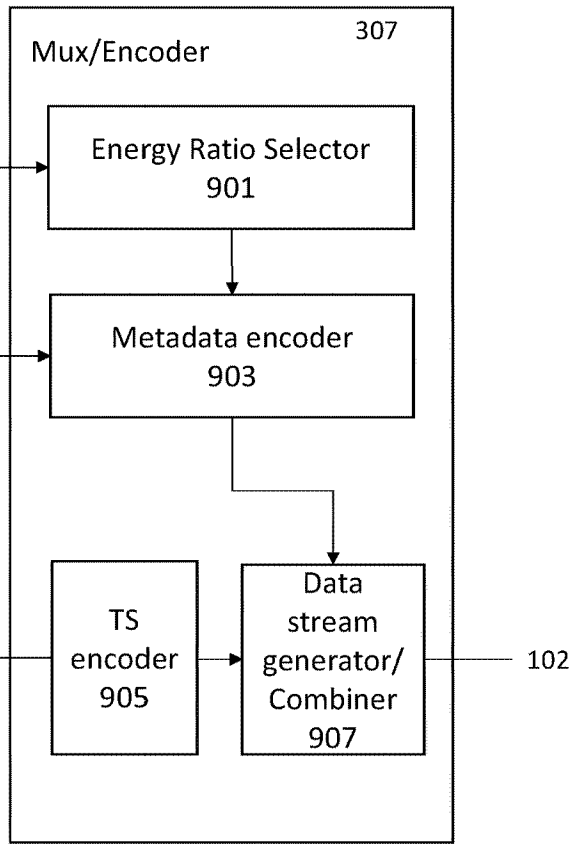

With respect to FIGS. 9*a* and 9*b* are shown examples of multiplexer/encoders which may be implemented in some embodiments. As discussed previously when high-quality audio reproduction is the target, the encoder should ideally encode all the information in the energy ratios. Where we have N energy ratios (and N streams) that sum to total of one, it may be possible to encode only N−1 streams in order to transmit all of the information (as the non-selected stream ratio can be determined from subtracting all of the other stream ratios from one. Selecting the one ratio that can be left out (or not selected) may be chosen to attempt to maximize the compression efficiency and may be implemented by analysing the statistics of the ratios and the 'correct' discarded ratio selected for each time frame. In some embodiments, this selection operation can be separate for each frequency band. However, the overhead in signalling the order of the ratios and/or the non-transmitted ratio also is controlled.

For example in FIG. 9*a* shows a first example of a static energy ratio selector. In this example the multiplexer/encoder 307 is configured to receive the determined energy ratios, the directions and the transport audio signals.

In some embodiments the multiplexer/encoder 307 comprises an energy ratio selector 901. The energy ratio selector 901 is configured to receive N energy ratios and select N−1 energy ratios to be passed to an encoder/combiner 903.

The multiplexer/encoder 307 may further comprise a metadata encoder/combiner 903 configured to receive the selected N−1 energy ratios and the directions and perform any suitable compression/encoding on the metadata (for example quantization or index coding) to generate compressed metadata.

The multiplexer/encoder 307 may further comprise a transport audio signal encoder/combiner 905 configured to receive the transport audio signals and perform any suitable compression/encoding on the transport audio signals to generate suitable compressed audio signals.

The multiplexer/encoder 307 may furthermore comprise a data stream generator/combiner 907 configured to receive the compressed metadata and transport audio signals and generate the output data stream 102.

In some embodiments the energy ratio selector 901 is configured to send a static arrangement which is determined once and is known between the analysis device and the rendering device. For example in some embodiments the static arrangement is defined by the codec designer or application designer.

With respect to FIG. 9*b* is shown a further example multiplexer/encoder. In these embodiments the energy ratio selector 901*a* is further controlled by an audio analyser (sound scene classifier) 911 which is configured to receive the transport audio signals (and/or the input audio signals) and control the selection of the energy ratios based on the analysis. For example in some embodiments the audio analyser is configured to determine a classification of the audio scene and this is passed to the energy ratio selector 901*a*.

The energy ratio selector 901*a* is then configured in some embodiments to select the ratio to be left out based on the analysis (for example based on the classification of the audio scene).

Figure 10:
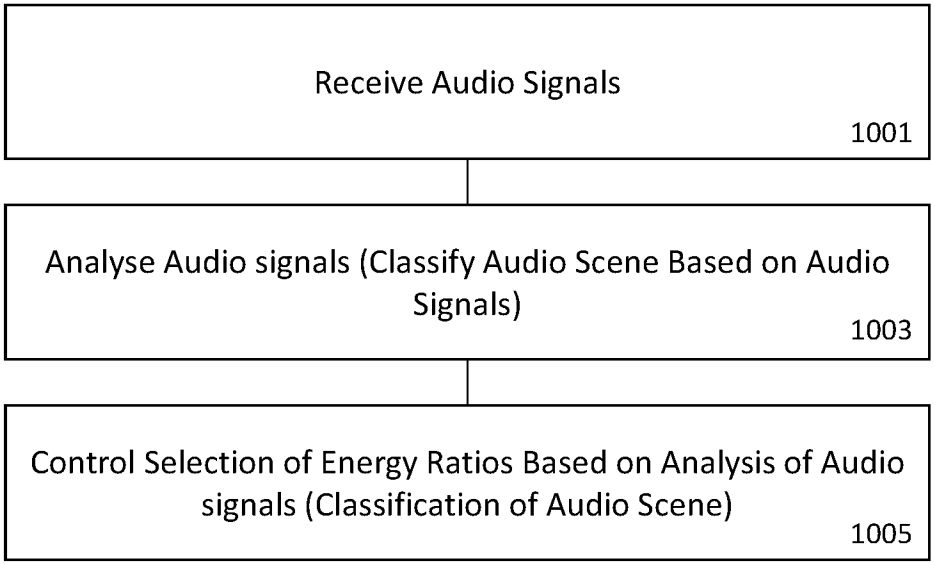
FIG. 10 shows a flow diagram of the operation of the energy ratio signalling apparatus shown in FIGS. 9*a* and 9*b* according to some embodiments.

This may be summarised by the flow diagram as shown in FIG. 10 by step 1001.

The first operation is one of receiving/determining the audio signals and the metadata including the direct-to-total, diffuse-to-total and remainder energy ratios.

The following operation is one of analysing the audio scene (based on the audio signals) and in some embodiments furthermore classifying the scene as shown in FIG. 10 by step 1003.

Having analysed the scene then the selection/combination of the energy ratios to be transmitted/stored is controlled based on the analysis as shown in FIG. 10 by step 1005.

For example in an implementation where there are M analysed directions (where M≥1) there may be the following signalled or stored ratio options that allow the reproduction of all N (generally, N=M+2) energy ratios:

a) Provide all energy ratio streams:
   M direct-to-total, 1 diffuse-to-total, 1 remainder ratio stream
b) Provide M direct-to-total, 1 diffuse-to-total ratio stream (leave out the remainder ratio)
c) Provide M−1 direct-to-total, 1 diffuse-to-total, 1 remainder ratio stream
d) Provide M direct-to-total, 1 remainder ratio stream (leave out the diffuse-to-total ratio)

In case of providing an input to an audio encoder, any one of the four options (a-d) may apply. However, in case of an audio compression, such as a transmitted bitstream, one of the latter three options (b-d) is typically selected. In some cases, such as a lossless audio coding, it would be possible to also consider option a (providing all N energy ratio streams) in the transmitted bitstream. However, this is typically only the case when the same energy ratio streams are provided as input (with an input format consisting of at least audio waveform(s) and spatial metadata) or analysed inside the audio encoder (e.g., from a multi-channel loudspeaker signal or any other suitable audio input).

In some embodiments an adaptive allocation of the ratio selection may be implemented, and it may be implemented independently of other optimizations such as described herein. In some embodiments the adaptive allocation or selection can be based on long-term statistical analysis of the sound-scene signal(s).

In some embodiments the sound scene may be classified as being one of four classes (in some further embodiments there may be more than or less than four classes, furthermore in some embodiments there may be classes and then within each class sub-classes which control the allocation or selection). In this example the four classes for the sound-scene are:

1) Directional audio
2) Diffuse audio
3) Generic (a mixture or fluctuating)
4) Noisy (low-level or low SNR)

(As indicated above other classification types may also be possible in a similar framework. For example, Class=3 may not be used. However, typically then control of classification changes is stricter in a way of applying more stabilization. In other words enabling less fluctuation between the classes over time.)

In some embodiments the energy ratio selector 901*a* is configured for a scene defined as Class=1 to provide the direct-to-total ratios. In some embodiments the energy ratio selector 901*a* is configured for a scene defined as Class=2, to provide the diffuse-to-total ratio as well as possible. In some embodiments the energy ratio selector 901*a* is configured for a scene defined as Class=3, to provide both important directional components and a significant amount of diffuseness and/or there is significant switching between the two modes. The energy ratio selector 901*a* is configured for a scene defined Class=4 may be configured to select for storage or transmission the remainder ratio.

In general, the switching may thus be, for example between not transmitting the remainder ratio for Class=1 . . . 3 and a fixed arrangement of M direct-to-total and no diffuseness or M−1 direct-to-total with diffuseness for Class=4.

The classification may consider at least long-term values but, in some embodiments, also at least one short-term value of the M direct-to-total ratio streams, diffuse-to-total ratio stream, and remainder ratio stream. These values are typically considered together with a time-frequency interval absolute energy computation of the downmix audio signal.

The adaptive allocation can utilize at least one mode bit. The mode bit, may be used to indicate at least one long-term statistics-based sound-scene signal classification and may in some embodiments be used for other purposes in the audio encoding algorithm.

Thus in the four class above example, the at least one mode bit can indicate Class=1 . . . 3 vs. Class=4 (1 bit) or one of the Class=1,2,3,4 (e.g., 2 bits). In some embodiments the transmission of mode bit(s) for the selection may be considered to be excessive for transmission in every frame and therefore for a new frame, where there is no mode selection bit, then the mode of the current frame is copied from the previous frame. In some embodiments there may be implemented a maximum run of frame mode copying as this approach may lead to error propagation during a frame loss. For example, such a run can be a maximum of 10 frames.

In some embodiments to reduce the number of transmitted energy ratios, they can be combined together. The energy ratio selector may in some embodiments be configured to combine ratios when one of the energy ratios does not offer any additional information (in other words the energy ratio value is very low) or there is a strict bitrate budget that does not allow sending all of the energy ratio values.

Thus in some embodiments where the remainder-to-total ratio is not selected to be transmitted, the reduction can be implemented as follows:

The energy ratio selector for example may remove the diffuse-to-total ratio. This changes the energy ratio model from $$r_{diff} + r_{rem} + \sum_{i=1}^{M} r_{dir}(i) = 1$$

to $$r_{diff+rem} + \sum_{i=1}^{M} r_{dir}(i) = 1$$

In this, the combined energy ratio $r_{diff+rem}$ may then be transmitted/stored implicitly (in other words not actually transmitted) and it would be reproduced in synthesis as a diffuse stream.

This (combined) energy ratio can be then calculated at the synthesis processor from the direct-to-total energy ratios. In such embodiments there is effectively one ratio saved from transmitting/storing (and implicitly adds the remainder signal to the diffuse stream).

In some embodiments the energy ratio selector may be configured not to select for signalling the direct-to-total ratios. This would change the energy ratio model from:

$$r_{diff} + r_{rem} + \sum_{i=1}^{M} r_{dir}(i) = 1$$

to $$r_{diff} + r_{dir+rem} = 1$$

In these embodiments the combined energy ratio $r_{dir+rem}$ is transmitted implicitly (in other words not actually transmitted) and may be reproduced by the synthesis processor as a direct stream. Using the above relation, this combined energy ratio can be then calculated from the diffuse-to-total energy ratio. This method reduces the number ratios transmitted/stored by the number of direct streams and implicitly adds the remainder signal to the combined direct stream. In some embodiments this may additionally include implanting a combination of the direct streams.

In an example of the combination of the classification-based selection and the combination reduction embodiments may be for example the energy ratio selector being configured to:

For embodiments where the combination of $r_{dir+rem}$ is implemented:

Class=1: transmit direct-to-total ratio

Class=2: transmit diffuse-to-total ratio

Class=3: transmit diffuse-to-total ratio

Class=4: transmit direct-to-total ratio

For embodiments where the combination of $r_{diff+rem}$ is implemented:

Class=1: transmit M direct-to-total ratio

Class=2: transmit M−1 direct-to-total ratio+diffuse-to-total ratio

Class=3: transmit M direct-to-total ratio

Class=4: transmit M−1 direct-to-total ratio+diffuse-to-total ratio

In some embodiments the energy ratio selector 901*a* is further configured to reduce the number of direct-to-total energy ratios transmitted/stored.

For example low bitrate targets, a suitable target to aim for is the signalling of one direct and one diffuse stream. In other words targeting a ratio model of $$r_{diff}+r_{rem}+r_{dir}=1$$

Figure 11:
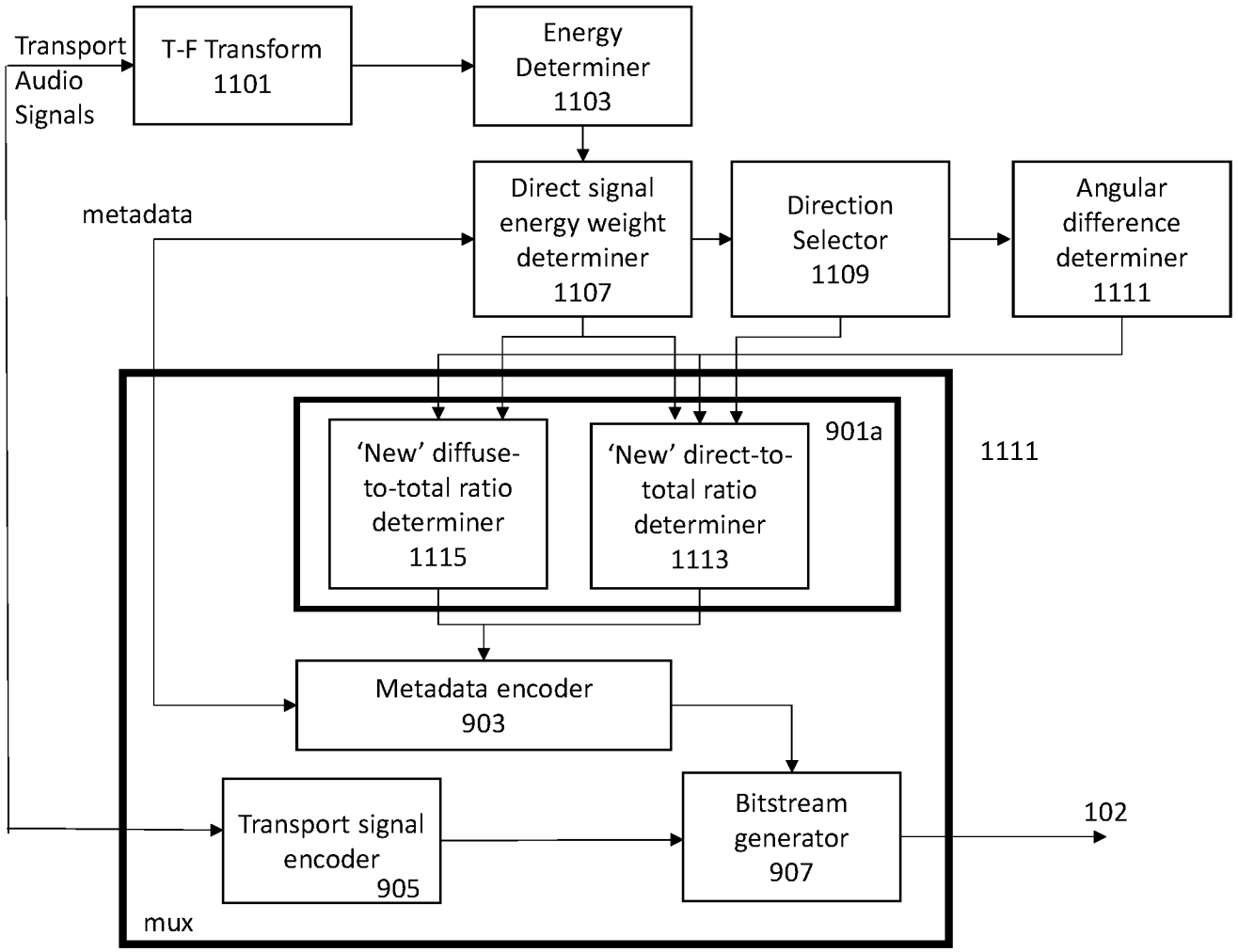
FIG. 11 shows schematically capture/encoding apparatus incorporating energy ratio combination based on a previously encoded audio signal and spatial metadata input according to some embodiments.

For example FIG. 11 shows in further detail the apparatus shown in FIG. 9*b* where the input to the system is the transport audio signals and the determined metadata.

In this example the transport audio signals are passed to a time-frequency domain transformer 1101 configured to generate time-frequency domain representations of the transport audio signals.

The time-frequency domain representations of the transport audio signals may then be passed to an energy determiner 1103 configured to determine an energy value for the frequency bands associated with the metadata.

The energy values and furthermore the directional metadata may then be processed by a direct signal energy weight determiner 1107 which is configured to determine the direct signal energy weights (in a manner similar to that described herein previously).

The direct signal energy weights may furthermore be passed to a direction selector 1109 configured to select the largest weight based direction as the 'main' direction.

Furthermore the other direction parameters may then be compared to the 'main' direction in an angular difference determiner 1111 in order to determine a measure of the angular difference between the other directions and the 'main' direction.

In some embodiments the energy ratio selector 901*a* may comprise a direct-to-total energy ratio determiner 1113 configured to generate a new 'main' direct-to-total energy ratio based on the direct-to-total energy ratio associated with the determined main direction and the angular difference determinations. For example the direct-to-total energy ratio determiner 1113 may be configured to generate a processed direct-to-total energy ratio according to the following equation:

$$r_{\text{dir_main}} = \sum_{i=1}^{M}\left(1-\frac{\varphi_d(i)}{\varphi_{dmax}}\right)*r_{dir}(i)$$

where $\varphi_d(i)$ is the angular difference between the main direction and current direction and $\varphi_{dmax}$ is the maximum allowed angular difference (in other words where the determined difference is larger than the maximum, it is limited to the maximum). An example of the maximum difference may be 180°.

In some embodiments the energy ratio selector 901*a* may comprise a diffuse-to-total energy ratio determiner 1115 configured to generate a new 'main' diffuse-to-total energy ratio based on the diffuse-to-total energy ratio associated with the determined main direction and the angular difference determinations. For example the diffuse-to-total energy ratio determiner 1115 may be configured to generate a processed diffuse-to-total energy ratio according to the following equation:

$$r_{\text{diff_processed}} = r_{diff} + \sum_{i=1}^{M}\left(\frac{\varphi_d(i)}{\varphi_{dmax}}\right)*r_{dir}(i)$$

These may then be passed to the metadata encoder 903 with the direction parameters to be encoded in any suitable manner.

Furthermore the transport signal encoder 905 may be configured to receive the transport audio signals and encode them according to any suitable method.

The bitstream generator 907 may then receive the encoded metadata and transport audio signals and combine them to generate the bitstream 102.

Figure 13:
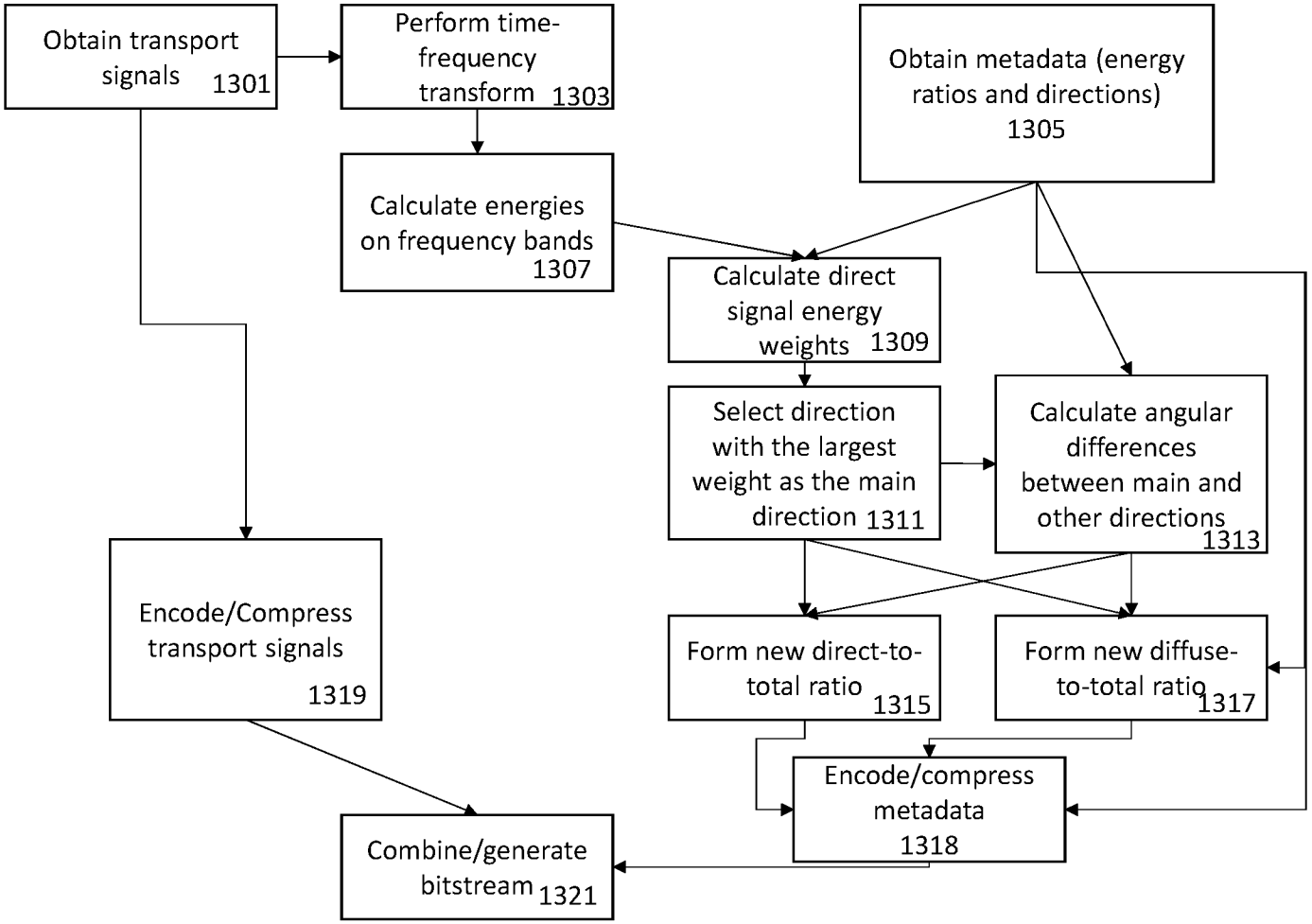
FIG. 13 shows a flow diagram of the operation of capture/encoding apparatus incorporating energy ratio combination based on a previously encoded audio signal and spatial metadata input shown in FIG. 11 according to some embodiments.

FIG. 13 furthermore shows a flow diagram of the operation of the apparatus shown in FIG. 11.

The transport audio signals are received/obtained as shown in FIG. 13 by step 1301.

The transport audio signals may be transformed into the time-frequency domain as shown in FIG. 13 by step 1303.

Furthermore the transformed time-frequency domain transport audio signals are then processed to determine energies on the frequency bands as shown in FIG. 13 by step 1307.

Furthermore the metadata (the energy ratios and the directions) are received/obtained as shown in FIG. 13 by step 1305.

Based on the energy values and the metadata the direct signal energy weights are then determined as shown in FIG. 13 by step 1309.

Furthermore based on the direct signal energy weights the direction with the largest weight is selected as the main direction as shown in FIG. 13 by step 1311.

A series of angular differences between the main and the other directions may then be determined based on the metadata direction parts as shown in FIG. 13 by step 1313.

Based on the selected main direction direct-to-total energy ratio, the other direct-to-total energy ratios and the angular differences a new modified direct-to-total energy ratio is determined as shown in FIG. 13 by step 1315.

Based on the diffuse-to-total energy ratios, the main direct-to-total energy ratio, the other direct-to-total energy ratios, and the angular differences a new modified diffuse-to-total energy ratio is determined as shown in FIG. 13 by step 1317.

The new direct-to-total energy ratios, the new diffuse-to-total energy ratios and the directions may then be encoded to form encoded energy ratios as shown in FIG. 13 by step 1318.

Furthermore the transport audio signals are compressed as shown in FIG. 13 by step 1319.

The compressed transport audio signals, and the modified direct-to-total energy ratio and the modified diffuse-to-total energy ratio may then be combined and encoded to form the data-stream or bitstream as shown in FIG. 13 by step 1321.

Figure 12:
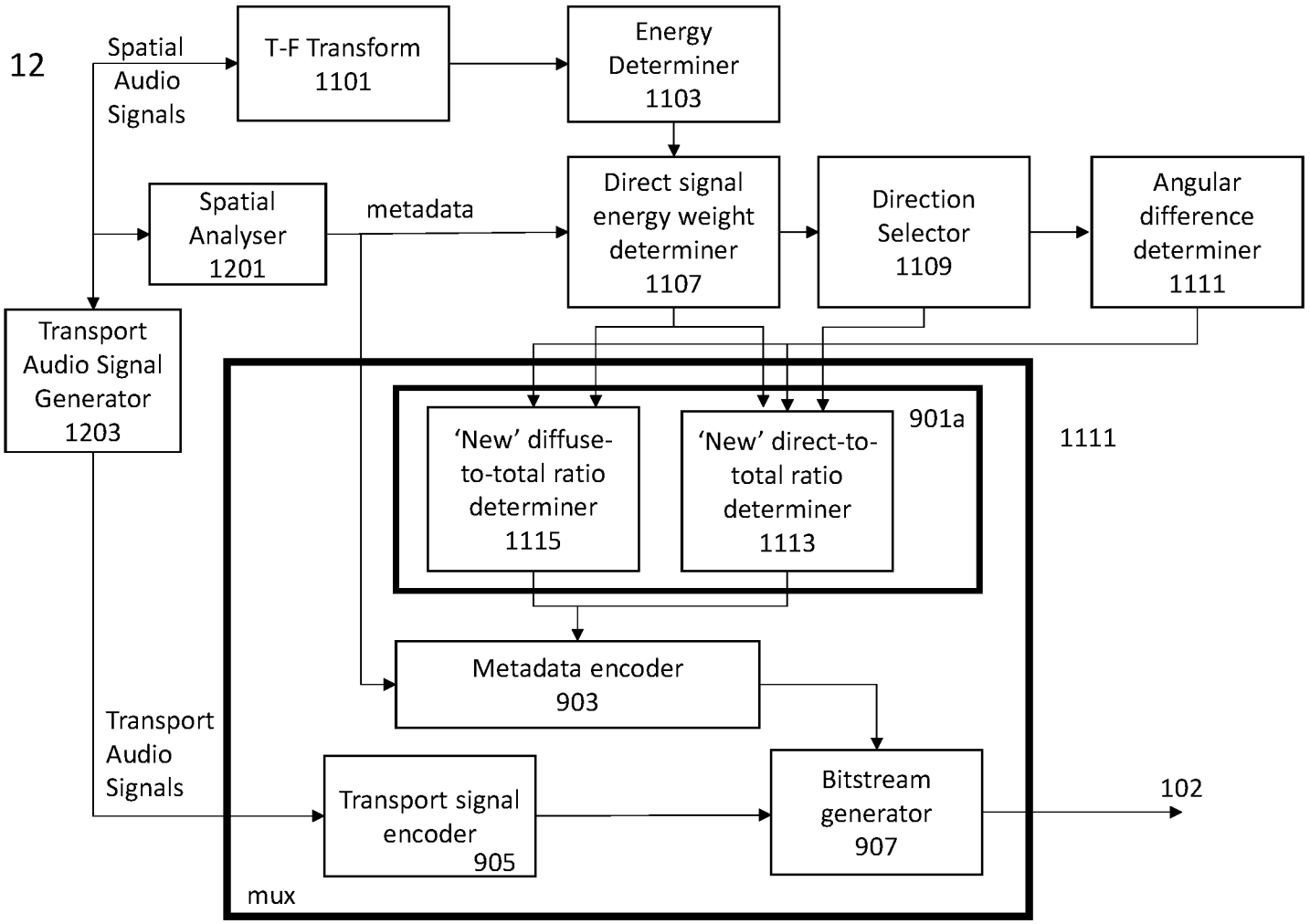
FIG. 12 shows schematically capture/encoding apparatus incorporating energy ratio combination based on a captured multichannel audio signal input according to some embodiments.

FIG. 12 shows in further detail the apparatus shown in FIG. 9*b* where the input to the system are captured audio signals (or similar multichannel audio signals).

In this example the (spatial) audio signals are passed to a time-frequency domain transformer 1101 configured to generate time-frequency domain representations of the (spatial) audio signals.

A spatial analyser 1201 is configured to receive the time-frequency domain representations of the (spatial) audio signals and determine the direction and energy ratio metadata according to any suitable method.

The time-frequency domain representations of the (spatial) audio signals may then be passed to an energy determiner 1103 configured to determine an energy value for the frequency bands associated with the metadata.

The energy values and furthermore the directional metadata may then be processed by a direct signal energy weight determiner 1107 which is configured to determine the direct signal energy weights (in a manner similar to that described herein previously).

The direct signal energy weights may furthermore be passed to a direction selector 1109 configured to select the largest weight based direction as the 'main' direction.

Furthermore the other direction parameters may then be compared to the 'main' direction in an angular difference determiner 1111 in order to determine a measure of the angular difference between the other directions and the 'main' direction.

In some embodiments the energy ratio selector 901*a* may comprise a direct-to-total energy ratio determiner 1113 configured to generate a new 'main' direct-to-total energy ratio based on the direct-to-total energy ratio associated with the determined main direction and the angular difference determinations. For example the direct-to-total energy ratio determiner 1113 may be configured to generate a processed direct-to-total energy ratio according to the following equation:

$$r_{\text{dir_main}} = \sum_{i=1}^{M} \left(1 - \frac{\varphi_d(i)}{\varphi_{dmax}}\right) * r_{dir}(i)$$

where $\varphi_d(i)$ is the angular difference between the main direction and current direction and $\varphi_{dmax}$ is the maximum allowed angular difference (in other words where the determined difference is larger than the maximum, it is limited to the maximum). An example of the maximum difference may be 180°.

In some embodiments the energy ratio selector 901*a* may comprise a diffuse-to-total energy ratio determiner 1115 configured to generate a new 'main' diffuse-to-total energy ratio based on the diffuse-to-total energy ratio associated with the determined main direction and the angular difference determinations. For example the diffuse-to-total energy ratio determiner 1115 may be configured to generate a processed diffuse-to-total energy ratio according to the following equation:

$$r_{\text{diff_processed}} = r_{diff} + \sum_{i=1}^{M} \left(\frac{\varphi_d(i)}{\varphi_{dmax}}\right) * r_{dir}(i)$$

In some embodiments the system comprises a transport audio signal generator 1203 configured to generate suitable transport audio signals from the input (spatial) audio signals.

These may then be passed to the metadata encoder 903 with the direction parameters to be encoded in any suitable manner.

Furthermore the transport signal encoder 905 may be configured to receive the transport audio signals and encode them according to any suitable method.

The bitstream generator 907 may then receive the encoded metadata and transport audio signals and combine them to generate the bitstream 102.

Figure 14:
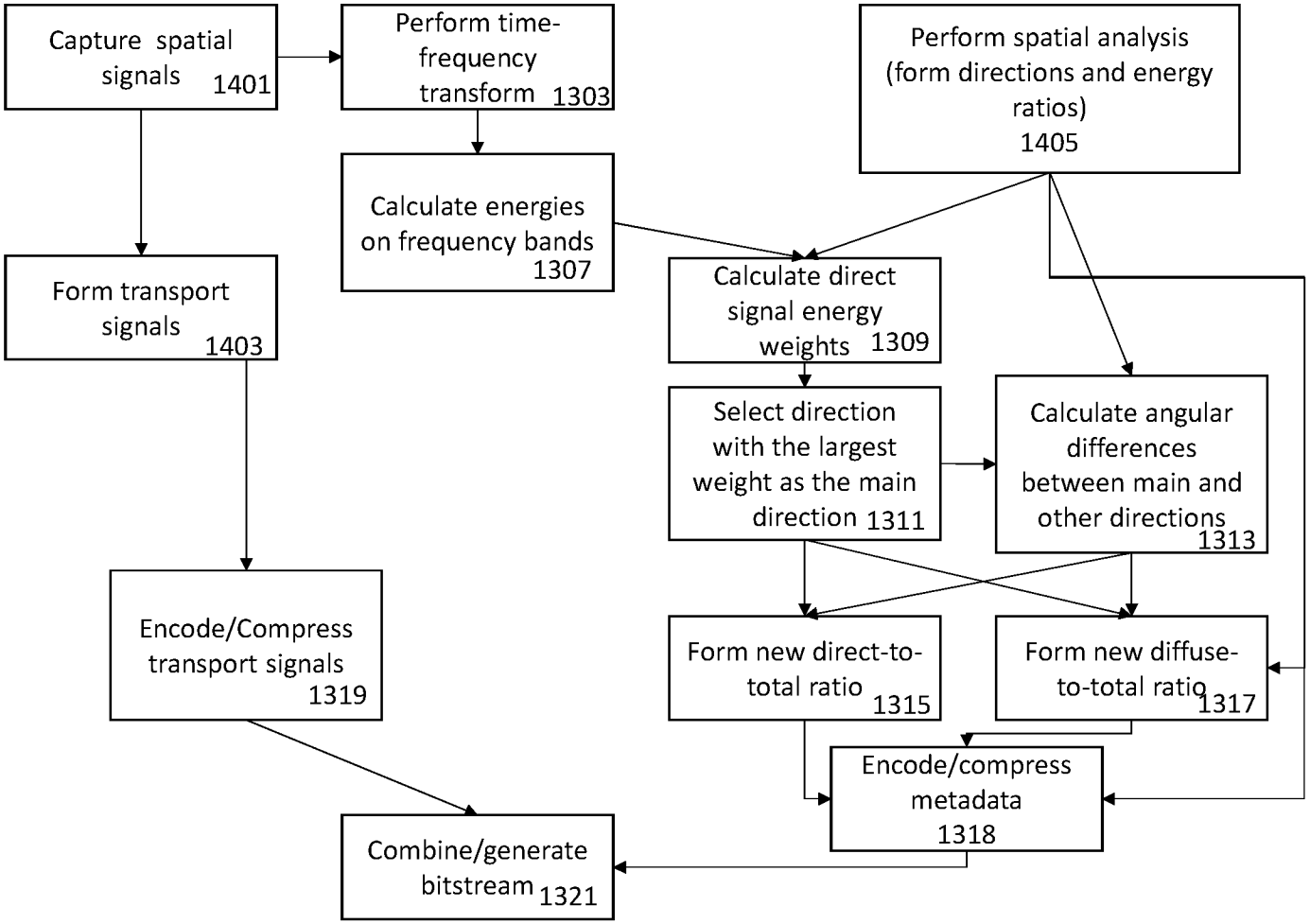
FIG. 14 shows a flow diagram of the operation of capture/encoding apparatus incorporating energy ratio combination based on a captured multichannel audio signal input shown in FIG. 12 according to some embodiments.

FIG. 14 furthermore shows a flow diagram of the operation of the apparatus shown in FIG. 12.

The spatial audio signals are captured/received/obtained as shown in FIG. 14 by step 1401.

The spatial audio signals may be transformed into the time-frequency domain as shown in FIG. 14 by step 1303.

Furthermore the transformed time-frequency domain spatial audio signals are then processed to determine energies on the frequency bands as shown in FIG. 14 by step 1307.

Furthermore the metadata (the energy ratios and the directions) are determined by applying spatial analysis to the spatial audio signals as shown in FIG. 14 by step 1405.

Based on the energy values and the metadata the direct signal energy weights are then determined as shown in FIG. 14 by step 1309.

Furthermore based on the direct signal energy weights the direction with the largest weight is selected as the main direction as shown in FIG. 14 by step 1311.

A series of angular differences between the main and the other directions may then be determined based on the metadata direction parts as shown in FIG. 14 by step 1313.

Based on the selected main direction direct-to-total energy ratio, the other direct-to-total energy ratios and the angular differences a new modified direct-to-total energy ratio is determined as shown in FIG. 14 by step 1315.

Based on the diffuse-to-total energy ratios, the main direct-to-total energy ratio, the other direct-to-total energy ratios, and the angular differences a new modified diffuse-to-total energy ratio is determined as shown in FIG. 14 by step 1317.

The new direct-to-total energy ratios, the new diffuse-to-total energy ratio(s) and the directions may then be encoded to form encoded energy ratios as shown in FIG. 13 by step 1318.

Furthermore the transport audio signals are generated from the spatial audio signals as shown in FIG. 14 by step 1403.

The transport audio signals may then be compressed as shown in FIG. 14 by step 1319.

The compressed transport audio signals, and the compressed metadata may then be combined and encoded to form the data-stream or bitstream as shown in FIG. 14 by step 1321.

In some embodiments instead of selecting the main direction using the largest weight direction, a weighted average of all directions is calculated and this is used as the main direction for the equations. This averaging produces a direction that has least distance from all directions.

In some embodiments all of the other direct-to-total energy ratios are added to the main direct-to-total energy ratio.

In some embodiments the above energy division is applied to direct-to-total energy ratios and remainder-to-total energy ratios instead.

In some embodiments any suitable number of direct-to-total ratios are used as the reduction. In other words, generating $M_{red}<M$ number of directional streams. In these embodiments the desired number of streams with smallest signal energy weights are selected for combination. This allows gradual reduction of streams.

Figure 15:
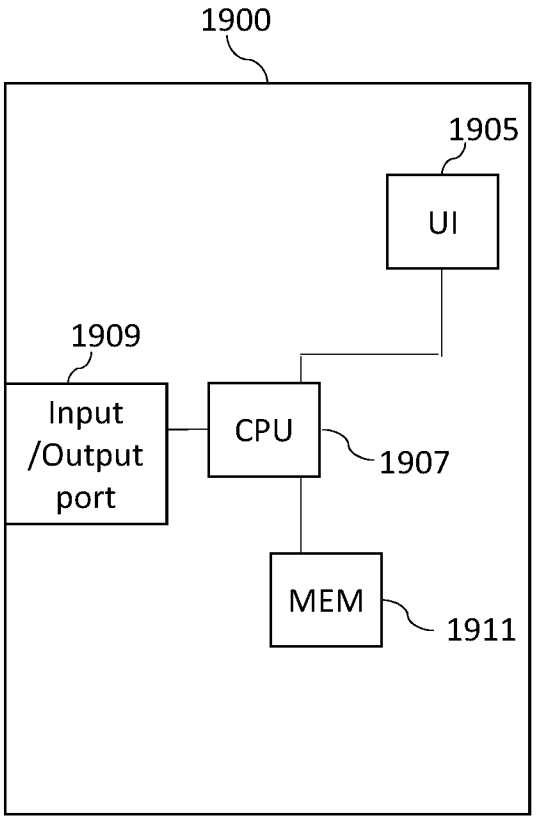
FIG. 15 shows schematically shows schematically an example device suitable for implementing the apparatus shown.

With respect to FIG. 15 an example electronic device which may be used as the analysis or synthesis device is shown. The device may be any suitable electronics device or apparatus. For example in some embodiments the device 1400 is a mobile device, user equipment, tablet computer, computer, audio playback apparatus, etc.

In some embodiments the device 1900 comprises at least one processor or central processing unit 1907. The processor 1907 can be configured to execute various program codes such as the methods such as described herein.

In some embodiments the device 1900 comprises a memory 1911. In some embodiments the at least one processor 1907 is coupled to the memory 1911. The memory 1911 can be any suitable storage means. In some embodiments the memory 1911 comprises a program code section for storing program codes implementable upon the processor 1907. Furthermore in some embodiments the memory 1911 can further comprise a stored data section for storing data, for example data that has been processed or to be processed in accordance with the embodiments as described herein. The implemented program code stored within the program code section and the data stored within the stored data section can be retrieved by the processor 1907 whenever needed via the memory-processor coupling.

In some embodiments the device 1900 comprises a user interface 1905. The user interface 1905 can be coupled in some embodiments to the processor 1907. In some embodiments the processor 1907 can control the operation of the user interface 1905 and receive inputs from the user interface 1905. In some embodiments the user interface 1905 can enable a user to input commands to the device 1900, for example via a keypad. In some embodiments the user interface 1905 can enable the user to obtain information from the device 1900. For example the user interface 1905 may comprise a display configured to display information from the device 1900 to the user. The user interface 1905 can in some embodiments comprise a touch screen or touch interface capable of both enabling information to be entered to the device 1900 and further displaying information to the user of the device 1900.

In some embodiments the device 1900 comprises an input/output port 1909. The input/output port 1909 in some embodiments comprises a transceiver. The transceiver in such embodiments can be coupled to the processor 1907 and configured to enable a communication with other apparatus or electronic devices, for example via a wireless communications network. The transceiver or any suitable transceiver or transmitter and/or receiver means can in some embodiments be configured to communicate with other electronic devices or apparatus via a wire or wired coupling.

The transceiver can communicate with further apparatus by any suitable known communications protocol. For example in some embodiments the transceiver or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

The transceiver input/output port 1909 may be configured to receive the loudspeaker signals and in some embodiments determine the parameters as described herein by using the processor 1907 executing suitable code. Furthermore the device may generate a suitable transport signal and parameter output to be transmitted to the synthesis device.

In some embodiments the device 1900 may be employed as at least part of the synthesis device. As such the input/output port 1909 may be configured to receive the transport signals and in some embodiments the parameters determined at the capture device or processing device as described herein, and generate a suitable audio signal format output by using the processor 1907 executing suitable code. The input/output port 1909 may be coupled to any suitable audio output for example to a multichannel speaker system and/or headphones or similar.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising at least one processor and at least one memory including a computer program code, the at least one memory and the computer program code configured to, with the at least one processor, cause the apparatus at least to:

receive at least one audio signal;

for the at least one audio signal over at least one frequency band, obtain at least one directional energy ratio, at least one diffuse energy ratio and a remainder energy ratio based on directional, diffuse and remainder portions of the received at least one audio signal;

determine at least one signal energy of the at least one frequency band;

determine energy weights for the directional and diffuse portions, for the at least one frequency band, based on the obtained at least one directional energy ratio, the at least one diffuse energy ratio and the determined at least one signal energy of the at least one frequency band; and form directional and diffuse streams, associated with the at least one audio signal, by distributing the remainder portion into at least one of directional and diffuse portions using the determined energy weights and the obtained energy ratios.

2. An apparatus comprising at least one processor and at least one memory including a computer program code, the at least one memory and the computer program code configured to, with the at least one processor, cause the apparatus at least to:

receive at least one audio signal;

for the at least one audio signal over at least one frequency band, obtain at least one directional energy ratio, at least one diffuse energy ratio and a remainder energy ratio based on directional, diffuse and remainder portions of the received at least one audio signal, wherein said energy ratios are configured to, at least partially, form directional and diffuse sound streams associated with the at least one audio signal;

prepare a combined energy ratio, for the at least one frequency band, wherein the remainder energy ratio is combined with one of the at least one directional energy ratio or the at least one diffuse energy ratio to form a combined energy ratio; and provide the at least one audio signal and the combined energy ratio to form said directional and diffuse sound streams, depending on the combined energy ratio.

3. The apparatus as claimed in claim 2, wherein the apparatus is further caused to reduce a number of the ratios that are transmitted.

4. The apparatus as claimed in claim 1, wherein the apparatus is caused to form the directional and diffuse streams by distributing the remainder portion into the directional portion and the diffuse portion based on the energy weights for the directional and diffuse portions, respectively.

5. The apparatus as claimed in claim 1, further caused to:

determine a main direction of the directional portion; and determine a spatial extent angle based upon the at least one directional energy ratio for the main direction, and wherein the apparatus is further caused to form the directional and diffuse streams by distributing the remainder portion based on the spatial extent angle and the main direction.

6. The apparatus as claimed in claim 5, wherein the apparatus is caused to determine the main direction by determining energy weights for each of a plurality of directions associated with the directional portion and selecting a direction having the largest signal energy weight as the main direction.

7. The apparatus as claimed in claim 2, wherein the apparatus is further caused to select the energy ratios to be combined and to be provided with the at least one audio signal at least one of:

a long term classification; or a short term classification.

8. The apparatus as claimed in claim 2, wherein the apparatus is caused to prepare the combined energy ratio by combining the remainder energy ratio with the at least one diffuse energy ratio.

9. The apparatus as claimed in claim 2, further caused to:

combine the at least one directional energy ratios for a plurality of directions; and combine the plurality of directions.

10. The apparatus as claimed in claim 9, wherein the apparatus is caused to combine the at least one directional energy ratios by determining a main direction and determining the at least one directional energy ratios for directions other than the main direction based upon an angular difference between the main direction and a respective direction for the at least one directional energy ratio.

11. The apparatus as claimed in claim 10 wherein the apparatus is caused to determine the main direction by determining energy weights for the plurality of directions of the at least one directional sound stream based on the directional energy ratios for the plurality of directions and selecting a direction for which the energy weight is largest as the main direction.

12. The apparatus as claimed in claim 10 wherein the apparatus is caused to determine the main direction by determining a weighted average for the plurality of directions of the directional portion of the at least one audio signal.

13. A method comprising:

receiving at least one audio signal;

for the at least one audio signal over at least one frequency band, obtaining at least one directional energy ratio, at least one diffuse energy ratio and a remainder energy ratio based on directional, diffuse and remainder portions of the received at least one signal;

determining at least one signal energy of the at least one frequency band;

determining energy weights for the directional and diffuse portions, for the at least one frequency band, based on the obtained at least one directional energy ratio, the at least one diffuse energy ratio and the determined at least one signal energy of the at least one frequency band; and forming directional and diffuse streams, associated with the at least one audio signal, by distributing the remainder portion into at least one of the directional and diffuse portions using the determined energy weights and the obtained energy ratios.

14. The method as claimed in claim 13, wherein forming the directional and diffuse streams comprises distributing the remainder portion into the directional portion and the diffuse portion based on the energy weights for the directional and diffuse portions, respectively.

15. The method as claimed in claim 13, further comprising:

determining a main direction of the directional portion; and determining a spatial extent angle based upon the at least one directional energy ratio for the main direction, and wherein forming the directional and diffuse streams comprises distributing the remainder portion based on the spatial extent angle and the main direction.

16. The method as claimed in claim 15, wherein determining the main direction comprises determining energy weights for each of a plurality of directions associated with the directional portion and selecting a direction having the largest signal energy weight as the main direction.

17. A method comprising:

receiving at least one audio signal;

for the at least one audio signal over at least one frequency band, obtaining at least one directional energy ratio, at least one diffuse energy ratio and a remainder energy ratio based on directional, diffuse and remainder portions of the received at least one audio signal, wherein said energy ratios are configured to, at least partially, form directional and diffuse sound streams associated with the at least one audio signal;

preparing a combined energy ratio, for the at least one frequency band, wherein the remainder energy ratio is combined with one of the at least one directional energy ratio and the at least one diffuse energy ratio; and providing the at least one audio signal and the combined energy ratio to form said directional and diffuse sound streams, depending on the combined energy ratio.

18. The method as claimed in claim 17, wherein forming the combined energy ratio comprises combining the remainder energy ratio with the at least one diffuse energy ratio to form the combined energy ratio.

19. The method as claimed in claim 17, further comprising:

combining the at least one directional energy ratios for a plurality of directions; and combining the plurality of directions.

20. The method as claimed in claim 19, wherein combining the direct energy ratios comprises determining a main direction and determining the at least one directional energy ratios for directions other than the main direction based upon an angular difference between the main direction and a respective direction for the at least one directional energy ratio.

21. The method as claimed in claim 20 wherein determining the main direction comprises determining energy weights for the plurality of directions of the at least one directional sound stream based on the directional energy ratios for the plurality of directions and selecting a direction for which the energy weight is largest as the main direction.

22. The method as claimed in claim 20 wherein determining the main direction comprises determining a weighted average for the plurality of directions of the directional portion of the at least one audio signal.

* * * * *